US009188924B2

(12) United States Patent
Kaneko et al.

(10) Patent No.: US 9,188,924 B2
(45) Date of Patent: Nov. 17, 2015

(54) IMAGE FORMING APPARATUS AND IMAGE FORMING METHOD

(71) Applicants: Satoshi Kaneko, Kanagawa (JP); Shinji Kato, Kanagawa (JP); Hitoshi Ishibashi, Kanagawa (JP); Shuji Hirai, Tokyo (JP); Jun Yamane, Kanagawa (JP); Koichi Kudo, Kanagawa (JP); Shingo Suzuki, Kanagawa (JP)

(72) Inventors: Satoshi Kaneko, Kanagawa (JP); Shinji Kato, Kanagawa (JP); Hitoshi Ishibashi, Kanagawa (JP); Shuji Hirai, Tokyo (JP); Jun Yamane, Kanagawa (JP); Koichi Kudo, Kanagawa (JP); Shingo Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/782,389

(22) Filed: Mar. 1, 2013

(65) Prior Publication Data

US 2013/0243457 A1 Sep. 19, 2013

(30) Foreign Application Priority Data

Mar. 14, 2012 (JP) ..... 2012-057846

(51) Int. Cl.

*G03G 15/01* (2006.01)
*G03G 15/00* (2006.01)
*G03G 15/08* (2006.01)
(Continued)

(52) U.S. Cl.

CPC ..... *G03G 15/5058* (2013.01); *G03G 15/0849* (2013.01); *G03G 15/5008* (2013.01); *G03G 13/22* (2013.01); *G03G 15/22* (2013.01); *G03G 2215/00037* (2013.01); *G03G 2215/00063* (2013.01); *G03G 2215/0161* (2013.01)

(58) Field of Classification Search

CPC ..... G03G 15/5054; G03G 15/5058; G03G 2215/00037; G03G 2215/00063
USPC ..... 399/26, 49, 72, 301
See application file for complete search history.

(56) References Cited

U.S. PATENT DOCUMENTS 5,854,958 A * 12/1998 Tanimoto et al. ..... 399/49
2004/0253012 A1 12/2004 Ishibashi
2004/0253014 A1* 12/2004 Bares ..... 399/49
(Continued)

FOREIGN PATENT DOCUMENTS

CN 1591214 A 3/2005
JP 62-114526 5/1987
(Continued)

OTHER PUBLICATIONS

Combined Chinese Office Action and Search Report issued May 20, 2015 in Patent Application No. 201310070644.3.
(Continued)

*Primary Examiner* — Benjamin Schmitt
(74) *Attorney, Agent, or Firm* — Oblon, McClelland, Maier & Neustadt, L.L.P.

(57) ABSTRACT

An image forming apparatus includes an image carrier; a developer carrier configured to adhere toner onto the image carrier; an image density detector to detect a density of an image on the image carrier formed by the developer carrier adhering the toner on the image carrier; a rotary member to form an image pattern of which density is detected by the image density detector; and a rotational position detector to detect a rotational position of the rotary member. In the image forming apparatus, the image pattern is generated based on the rotational position detected by the rotational position detector and the rotary member that the rotational position detector detects the rotational position thereof is either the image carrier or the developer carrier.

15 Claims, 13 Drawing Sheets

(51) Int. Cl.
*G03G 13/22* (2006.01)
*G03G 15/22* (2006.01)

(56) References Cited

U.S. PATENT DOCUMENTS

| | | | | |
|---|---|---|---|---|
| 2005/0047834 | A1* | 3/2005 | Tomita et al. | 399/301 |
| 2009/0297191 | A1* | 12/2009 | Hirai et al. | 399/49 |
| 2011/0206394 | A1* | 8/2011 | Takenaka | 399/46 |
| 2012/0201552 | A1* | 8/2012 | Hirai et al. | 399/49 |
| 2013/0108288 | A1 | 5/2013 | Kaneko et al. | |
| 2013/0243456 | A1 | 9/2013 | Kaneko et al. | |

FOREIGN PATENT DOCUMENTS

| | | |
|---|---|---|
| JP | 9-062042 | 3/1997 |
| JP | 2000-098675 | 4/2000 |
| JP | 2006-106556 | 4/2006 |
| JP | 2009-186909 A | 8/2009 |

OTHER PUBLICATIONS

Chinese Office Action issued on Jan. 30, 2015, in Chinese patent application No. 201310070644.3.

* cited by examiner

IMAGE FORMING APPARATUS AND IMAGE FORMING METHOD

CROSS-REFERENCE TO RELATED APPLICATION

The present application claims priority pursuant to 35 U.S.C. §119 from Japanese patent application number 2012-057846, filed on Mar. 14, 2012, the entire disclosure of which is incorporated by reference herein.

BACKGROUND

1. Technical Field

The present invention relates to an image forming apparatus forming an image using toner, such as a copier, a printer, a facsimile machine, a plotter, or a multi-function apparatus having at least one capability of the above devices. The present invention also relates to an image forming method employed in such an image forming apparatus and capable of detecting density of the image formed thereby.

2. Related Art

An image forming apparatus that employs a so-called electrophotographic method to form an image with toner has been known, as disclosed by, for example, JP-H09-62042-A, JP-3825184-B, and JP-2000-98675-A. Such an image forming apparatus forms an image in such a manner that a photoreceptor or an image carrier is uniformly charged by a charger, a latent image is formed on the photoreceptor by an exposure unit based on input image data corresponding to a to-be-formed image, and toner is adhered on the latent image by a developing device to thus render it visible.

Electrophotographic image forming apparatuses are widely used in the print industry and demand for faster, higher-quality apparatuses is rapidly increasing. Of those various quality requirements, uniform density over any given printed page is highly demanded and uniformity in the printed page is a decision factor when a user selects an image forming apparatus. Accordingly, minimizing density fluctuation in the printed page is most important.

Density fluctuation occurs due to various factors, such as an unstable charge due to uneven charging; fluctuation of exposure by an exposure unit; rotation fluctuation and variations in sensitivity of an image carrier such as a photoreceptor; variations in the resistance of a developer carrier such as a developing roller; fluctuation in the charge of the toner; and variations in the transferring of a transfer roller. Among these, it is particularly important to minimize density fluctuation caused by the rotary oscillation of the image carrier or unevenness in the sensitivity of the image carrier because such fluctuation occurs repeatedly within a single page because of its short cycle and is thus readily visible.

A description will now be given of the density fluctuation caused by the rotary oscillation of the image carrier.

In the image forming apparatus employing the electrophotographic method, toner is adhered on the image carrier using an electric field generated by an electric potential difference between the developer carrier and the image carrier. Therefore, when a development gap, which is a distance between the developer carrier and the image carrier, fluctuates due to the rotary oscillation of the image carrier, the electric field also fluctuates and causes image density changes or fluctuations.

The density fluctuation caused by the uneven sensitivity of the image carrier is as follows.

Specifically, when the sensitivity of the image carrier responsive to the exposure fluctuates due to factors such as an environmental change or aging deterioration, even though the exposure is performed at a constant exposure amount, the exposed bright area potential after the exposure of the image carrier fluctuates and the resultant electric field changes, so that the density fluctuation occurs. With regard to the uneven sensitivity of the image carrier, if the image carrier is manufactured using a high-precision production method in order to decrease the number of sensitivity errors, manufacturing costs soar.

As a correction technique for the density fluctuation, an approach is conceivable in which a pattern for the detection of density fluctuation is generated and correction data is obtained, so that process conditions such as charging bias, developing bias, and exposure may be changed based on the profiles of the density fluctuation due to the rotation cycle or the uneven sensitivity of the image carrier.

Accordingly, an approach is conceivable in which a developing bias is modulated responsive to a rotation cycle of the image carrier. Specifically, a rotational position detection sensor to detect a rotational position of the image carrier and a density sensor to detect a density of the image are used; a density fluctuation detected by the density detection sensor is divided by the cycle of the image carrier; and the developing bias is cyclically changed with a signal of the rotational position detection sensor as a trigger so that the electric field fluctuation due to the rotary oscillation is cancelled and the electric field becomes constant in order to minimize the detected density fluctuation.

To achieve the above approach, for example, in addition to the developing bias, the charging bias may also be modulated.

Density fluctuation caused by the uneven sensitivity of the image carrier also has other causes.

Specifically, the sensitivity of the toner adhering amount responsive to the electric field changes depending on the image density. That is to say, the sensitivity of the image carrier also changes depending on the image density. Specifically, in the shadow portion that is a high density portion such as a solid image with a high toner adhering amount, the difference in the potential between the exposed bright area potential and the developing bias, that is, the developing potential, becomes a dominant factor. Conversely, in a halftone or highlight image with less toner adhering amount than that of the shadow portion, the difference in the potential between the dark area potential which is the potential of a non-exposed portion of the image carrier and the developing bias, i.e., a background potential, is a dominant factor.

Accordingly, if the developing bias is controlled so as to correct the density fluctuation in the shadow portion, the control effect cannot be obtained in the halftone or highlight portion image and the density fluctuation increases.

JP-H09-62042-A discloses a technique to comprehensively decrease stripe-shaped density fluctuations that are cyclically generated in an image. This technique relates to an image forming apparatus employing an electrophotographic method or electrostatic recording process including a first fluctuation data storage means to previously store the cyclical density fluctuations data of the image density; and a first control means to control the image forming condition based on the density fluctuations data, in which the first fluctuation data storage means stores at least the density fluctuations data corresponding to one cycle of the developer carrier, and the first control means controls at least one of the charged voltage, the exposure light amount, the developer voltage, and the transfer voltage, whereby the density is corrected by the control means in accordance with the rotation cycle of the image carrier.

Alternatively, JP-3825184-B and JP-2000-98675-A disclose a technique to minimize the density fluctuation focusing on the rotation cycle of the developer carrier, not on the image carrier, thereby enabling a reduction of the image density fluctuation occurring at a developing roller rotation cycle by changing the developing bias responsive to the developing roller rotation cycle. Specifically, the developing bias is controlled by performing detection of the density fluctuation based on the image pattern formed on the image carrier and by adjusting each phase of the detected density fluctuation data and the developing roller rotation.

However, the above technique has a disadvantage in that, if the developing bias alone is controlled, even though the solid density correction is performed satisfactorily, the halftone density correction cannot be performed well.

To correct the density fluctuation due to the rotary oscillation of the image carrier, when the image pattern is formed so that the process condition is changed based on the rotation cycle of the image carrier, the length of the image pattern in the sub-scanning direction needs to be lengthened in general. As a result, such disadvantages will occur that the toner consumption amount increases, the load on the cleaning device increases, down time is lengthened, and the like.

When the rotational position detection to detect the rotational position of the image carrier and the density detection sensor to detect the image density are used as described above, detection of the formed image pattern by the density detection sensor is performed such that an average of the image patterns of n-cycles of the image carrier is obtained with reference to the rotational position detection sensor, and correction data is generated and stored.

In this case, there is a case in which the detection signal of the rotational position detection sensor does not come at a head of the image pattern due to the rotation start position of the image carrier to form the image pattern, so that the data acquisition becomes inadequate. To avoid such a situation, if the length of the image pattern in the sub-scanning direction is set to (n+1) cycles of the image carrier so as to securely detect the image pattern at a detection timing of the rotational position detection sensor, useless data is generated in the average acquisition. For example, substantially one cycle data of the image carrier becomes useless and toner used for the image pattern not used for the average acquisition becomes a waste, leading to a toner yield problem.

SUMMARY

The present invention provides an optimal image forming apparatus including an image carrier; a developer carrier configured to adhere toner onto the image carrier; an image density detector to detect a density of the image on the image carrier formed by the developer carrier adhering the toner on the image carrier; a rotary member to form an image pattern of which density is detected by the image density detector; a rotational position detector to detect a rotational position of the rotary member, wherein the image pattern is generated based on the rotational position detected by the rotational position detector.

The image forming apparatus is thus capable of minimizing a consumed toner amount and a required time for forming the image pattern by reducing the sub-scan length of the image pattern detected responsive to the rotary cycle of the rotary member.

These and other objects, features, and advantages of the present invention will become apparent upon consideration of the following description of the preferred embodiments of the present invention when taken in conjunction with the accompanying drawings.

DETAILED DESCRIPTION

Hereinafter, embodiments of the present invention will now be described with reference to the drawings.

Figure 1:
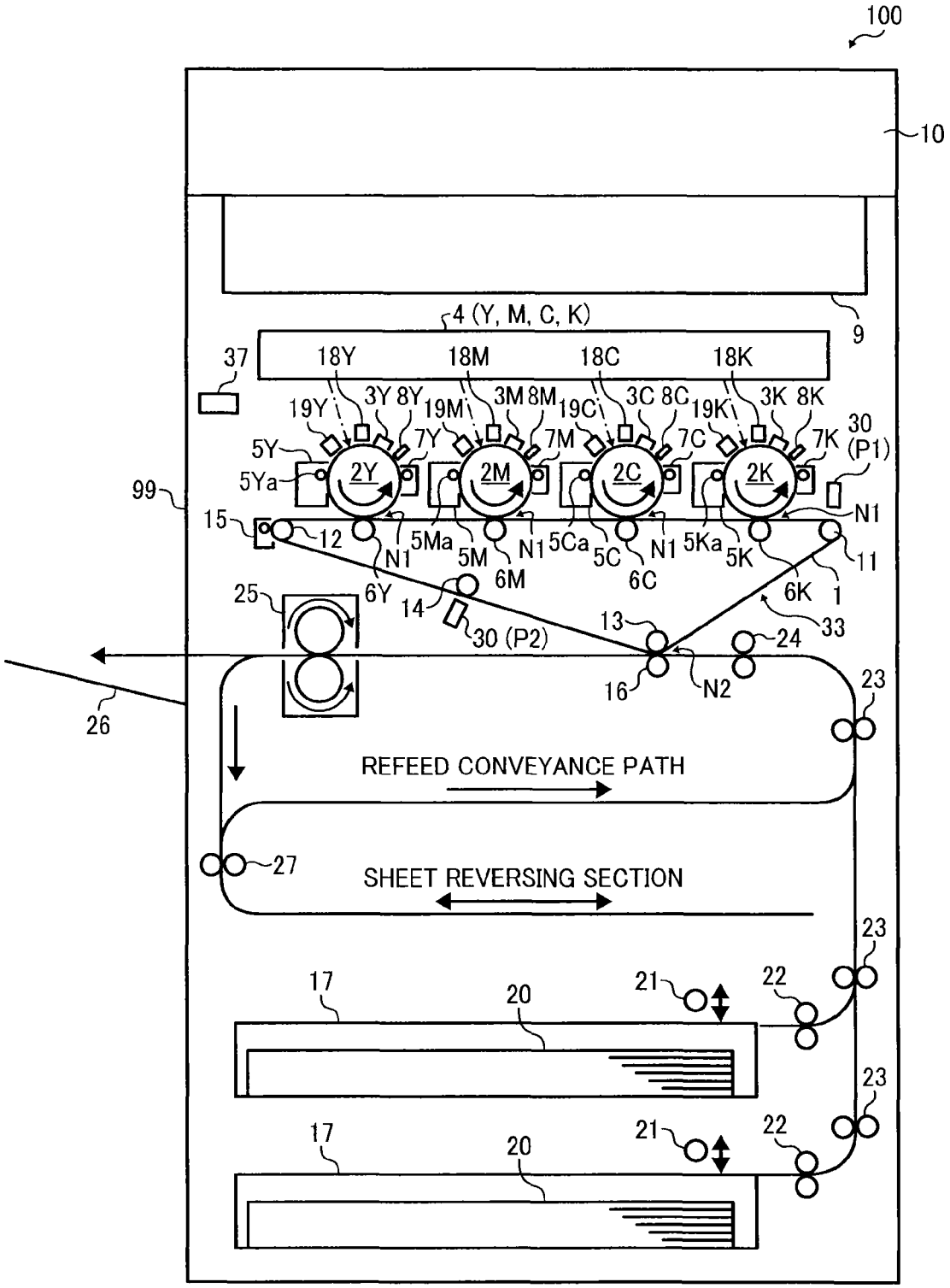
FIG. 1 is a schematic view of an image forming apparatus to which the present invention is applied.

FIG. 1 shows a schematic view of an image forming apparatus to which the present invention may be applied. As illustrated in FIG. 1, a full color copier, which employs a 4-storied tandem-type intermediate transfer method, is shown as an example of the application of the present invention; however, the present invention may be applied to other types of image forming apparatuses, including a 4-storied tandem-type direct transfer method applied full color copier or one-drum type intermediated transfer method applied full color copier, and the like. Further, the present invention may be applied to the one-drum type direct transfer method applied monochrome apparatus.

As illustrated in FIG. 1, the image forming apparatus 100 includes: an intermediate transfer belt 1 being an intermediate transfer body as an image carrier; and photoreceptor drums 2Y, 2M, 2C, and 2K as rotary members to carry an image thereon as a latent image carrier. The photoreceptor drums are arranged in parallel along a stretched surface of the intermediate transfer belt 1.

Herein, each affix of Y, M, C, and K represents a color of yellow, cyan, magenta, and black, respectively. A structure of a yellow image forming station will be described as a representative. In the order of the rotation direction of the photoreceptor drum 2Y, a charger 3Y as a charging means, a photo interrupter 18Y, an optical write unit 4Y, a surface potential sensor 19Y, a developing unit 5Y, a primary transfer roller 6Y, a photoreceptor cleaning unit 7Y, and a quenching lamp QL 8Y as a discharge means are disposed around the photoreceptor drum 2Y. The photo interrupter detects a rotational position or a phase of the photoreceptor drum 2Y. The optical write unit 4Y exposes a surface of the photoreceptor drum 2Y so as to write an electrostatic latent image thereon. The surface potential sensor 19Y detects an electric potential on the surface of the photoreceptor drum 2Y. The photoreceptor cleaning unit 7Y includes a blade and a brush, not shown, and cleans a surface of the latent image carrier.

A toner image forming means to form a toner image on the intermediate transfer belt 1 is implemented by the photoreceptor drum 2Y, the charger 3Y, the optical write unit 4Y, the developing unit 5Y, the primary transfer roller 6Y, and the like. A toner image formation by other image forming station is similarly performed.

The intermediate transfer belt 1 is rotatably supported by rollers 11, 12, and 13 serving as a plurality of support members. A belt cleaning unit 15 is disposed at a position opposed to the roller 12. The belt cleaning unit 15 includes a blade and a brush, both not shown. The intermediate transfer belt 1, rollers 11, 12, and 13, and the belt cleaning unit 15 inclusively form an intermediate transfer unit 33.

A secondary transfer roller 16 as a transfer means is disposed at a position opposed to the roller 13.

Above the optical write unit 4 including optical write units 4Y, 4C, 4M, and 4K, a scanner 9 as an image reading means and an automatic document feeder (ADF) 10 are disposed.

In the bottom of the main body of the image forming apparatus 99, there is provided a sheet feed tray 17 as a part to feed a plurality of sheets of paper.

A recording sheet 20 as a recording medium contained in each sheet feed tray 17 is fed by a pickup roller 21 and a sheet feed roller pair 22, and is conveyed by a conveyance roller pair 23. The recording sheet 20 is then conveyed by a registration roller pair 24 at a predetermined timing to a nip N2, as a secondary transfer portion, where the intermediate transfer belt 1 and a secondary transfer roller 16 are opposed each other.

A fixing unit 25 as a fixing means is disposed downstream of the nip N2 in the sheet conveyance direction.

In FIG. 1, a sheet discharge tray 26 is disposed at a side of the main body of the image forming apparatus. A reference numeral 27 represents a switchback roller pair and 37 represents a controller section as a controlling means including a CPU, a nonvolatile memory, a volatile memory, and the like.

Each of the developing units 5Y, 5C, 5M, and 5K includes a developing roller 5Ya, 5Ca, 5Ma, or 5Ka, respectively. Each developing roller as a rotary, developer carrier is disposed opposed to the corresponding photoreceptor drum 2Y, 2C, 2M, or 2K with a certain distance, that is, a developing gap. The developing rollers 5Ya, 5Ca, 5Ma, and 5Ka each carry two-component developer including toner and a carrier contained in the developing units 5Y, 5C, 5K, and 5K, respectively. The toner included in the two-component developer is adhered to the photoreceptor drums 2Y, 2C, 2M, and 2K at a developing nip where the photoreceptor drum and the developing roller are opposed, thereby forming an image on each of the photoreceptor drums 2Y, 2C, 2M, and 2K.

Above each of the photoreceptor drums 2Y, 2C, 2M, and 2K, photo interrupters 18Y, 18C, 18M, and 18K are disposed. In the present embodiment, as means to detect a rotational position of each photoreceptor drum 2Y, 2C, 2M, or 2K, photo interrupters 18Y, 18C, 18M, and 18K are used. However, any other means such as a rotary encoder may be alternatively used as long as a rotational position can be detected. Similarly, a rotational position detector for detecting a rotational position, i.e., a phase, of the developing rollers 5Ya, 5Ca, 5Ma, and 5Ka can be implemented by any means other than the photo interrupter as long as the rotational position can be detected.

Surface potential sensors 19Y, 19C, 19M, and 19K each detect a potential of the electrostatic latent image on each surface of the photoreceptor drums 2Y, 2C, 2M, and 2K written by the optical write units 4Y, 4C, 4M, and 4K, that is, before the electrostatic latent image on the photoreceptor drum 2Y, 2C, 2M, or 2K is supplied with toner and developed.

The detected surface potential is used for controlling a developing bias of each of the developing units 5Y, 5C, 5K, and 5K and is fed back to process conditions such as charging bias of the chargers 3Y, 3C, 3M, and 3K and laser powers of the optical write units 4Y, 4C, 4M, and 4K, and is used to maintain a stable image density.

The optical write units 4Y, 4C, 4M, and 4K each drive four semiconductor lasers, not shown, based on image data by way of laser controller, not shown, and radiate four writing beams to expose each of the photoreceptor drums 2Y, 2C, 2M, and 2K uniformly charged in the dark by the chargers 3Y, 3C, 3M, and 3K. The optical write unit 4 scans each of the photoreceptor drums 2Y, 2C, 2M, and 2K in the dark by the writing optical beams so that an electrostatic latent image for the colors of Y, C, M, and K is written on the surface of each of the photoreceptor drums 2Y, 2C, 2M, and 2K.

In the present embodiment, such an optical write unit 4Y, 4C, 4M, or 4K is used in which, while laser beams emitted from the semiconductor laser are being deflected by a polygon mirror, not shown, the deflected laser beams are reflected by a reflection mirror or are directed onto an optical lens, so that optical scanning is performed. As an optical writing unit 4, alternatively one executing the optical scanning by LED arrays may be used.

Referring to FIG. 1, an image forming operation will now be described. Upon input of a print start command, each roller around the photoreceptor drums 2Y, 2M, 2C, and 2K, around the intermediate transfer belt 1 and along the sheet conveyance path starts to rotate at a predetermined timing, and a recording sheet is started to be fed from the sheet feed tray 17.

Meanwhile, each surface of the photoreceptor drums 2Y, 2M, 2C, and 2K is charged uniformly by the charger 3Y, 3M, 3C, and 3K to the same electric potential, and is exposed, based on data for each image, by writing beams irradiated from the optical write units 4Y, 4C, 4M, and 4K. The potential pattern after exposure is called an electrostatic latent image. The surface of the photoreceptor drums 2Y, 2M, 2C, and 2K carrying the electrostatic latent image thereon is supplied with toner from the developing units 5Y, 5M, 5C, and 5K.

Then, the electrostatic latent image carried on the photoreceptor drums 2Y, 2M, 2C, and 2K is developed with a specific color.

In the structure as illustrated in FIG. 1, the photoreceptor drums 2Y, 2M, 2C, and 2K are provided for four colors of yellow, magenta, cyan, and black, of which the order is different from system to system. Accordingly, a toner image of yellow (Y), magenta (M), cyan (C), or black (K) is developed on a corresponding photoreceptor drum 2Y, 2M, 2C, or 2K.

The photoreceptor drums 2Y, 2M, 2C, and 2K and the intermediate transfer belt 1 contact each other to form a nip N1 as a primary transfer section. Primary transfer rollers 6Y, 6M, 6C, 6K are disposed opposing to the photoreceptor drums 2Y, 2M, 2C, and 2K, so that primary transfer bias and pressure are applied to the nip N1. The toner image developed on each of the photoreceptor drums 2Y, 2M, 2C, and 2K is then transferred to the intermediate transfer belt 1 by the primary transfer bias and pressure applied to the primary transfer rollers 6Y, 6M, 6C, and 6K at the nip N1. The primary transfer operation as above is repeated for four colors by adjusting a transferring timing, so that a full color toner image is formed on the intermediate transfer belt 1.

The full color toner image formed on the intermediate transfer belt 1 is transferred onto the recording sheet 20 which is fed and conveyed by the registration roller pair 24 at a proper timing in sync with the color toner image on the intermediate transfer belt 1. At this time, a secondary transfer is performed by a secondary transfer bias and pressing force applied to a secondary transfer roller 16. The recording sheet 20 onto which a full color toner image has been transferred passes the fixing unit 25 and the toner image carried on the recording sheet 20 is heated and fixed thereon.

If a target print is a one-sided print, the recording sheet 20 is directly conveyed to a sheet discharge tray 26. If the target print is a duplex print, a conveyance direction of the recording sheet 20 is changed upside down and the recording sheet 20 is conveyed to a sheet reversing section. Upon the recording sheet 20 reaching the sheet reversing section, the recording sheet 20 is switched back toward a reverse direction by a switchback roller pair 27 and comes out the sheet reversing section with its trailing end of the recording sheet 20 now the leading end. This is called a switchback operation, in which the recording sheet 20 is reversed. The recording sheet 20 of which surface is reversed does not return to the fixing unit 25, passes a refeed conveyance path, and joins the regular sheet conveyance path. Thereafter, the toner image is transferred onto the recording sheet 20 similarly in the case of the one-sided print, and the recording sheet 20 passes the fixing unit 25 and is discharged outside. This is the duplex print operation.

Thereafter, each of the photoreceptor drums 2Y, 2M, 2C, and 2K having passed the nip N1 carries residual toner after the primary transfer on a surface thereof, and the residual toner is removed from the surface of the photoreceptor by photoreceptor cleaning units 7Y, 7M, 7C, and 7K, respectively. Then, the surface of each of the photoreceptor drums 2Y, 2M, 2C, and 2K is uniformly discharged electrically by the QLs 8Y, 8M, 8C, and 8K, respectively, so that each of the photoreceptor drums 2Y, 2M, 2C, and 2K becomes ready for being charged for a next image formation. The intermediate transfer belt 1 that has passed the nip N2 carries residual toner after secondary transfer on a surface thereof. The residual toner after secondary transfer is also removed by the belt cleaning unit 15 and the intermediate transfer belt 1 becomes ready for a next image formation. By repeating such operations, either one-sided print or duplex print can be performed.

The image forming apparatus 100 includes a toner image sensor 30 as a density sensor to detect a density of the toner image formed on the outer circumferential surface of the intermediate transfer belt 1. In the present embodiment, the toner image sensor 30 is implemented as an optical sensor.

Thus, the toner image sensor 30 detects a density of the toner image of the image pattern formed on the surface of the intermediate transfer belt 1, of which the detection result will be used in correction control of the image density fluctuation.

In the embodiment as illustrated in FIG. 1, the toner image sensor 30 is disposed at a position P1 which is opposed to a part of the intermediate transfer belt 1 wound around a roller 11. Alternatively, the toner image sensor 30 may be positioned at a position P2 which is downstream of the nip N2 as in FIG. 1. When the toner image sensor 30 is positioned at the position P2 downstream of the nip N2, a roller 14, configured to stop fluctuation of the intermediate transfer belt 1, is preferably so disposed on an internal surface of the intermediate transfer belt 1 as to be opposed to the toner image sensor 30.

Among the two positions of the toner image sensor 30 described above, the position P1 before secondary transfer coincides with a position to detect the toner pattern on the intermediate transfer belt 1 before the secondary transfer process. If no specific limitation exists in the machine layout, the toner image sensor 30 is usually mounted at the position P1. Because the toner image sensor 30 is configured to detect the toner density upon the toner image as an image pattern for the correction control is formed, there is a shorter waiting time and no need of passing the toner image as an image pattern through the nip N2. Therefore, no specific artifice is necessary.

However, because there are many image forming apparatuses employing a configuration in which the secondary transfer position such as the nip N2 is disposed immediately after the fourth-color image forming station (see for example the black station in FIG. 1), disposing the toner image sensor 30 at the position P1 is difficult due to the limited space. In such a case, the toner image sensor 30 is disposed at the position P2 which is after the secondary transfer, the image pattern toner image formed on the intermediate transfer belt 1 is passed through the nip N2, and the toner image sensor 30 is to detect the density of the toner image after passing through the nip N2. There are two ways to pass through the nip N2: separate the secondary transfer roller 16 from the intermediate transfer belt 1, or apply reverse bias to the secondary transfer roller 16. The present embodiment is not limited to either way.

Figure 2:
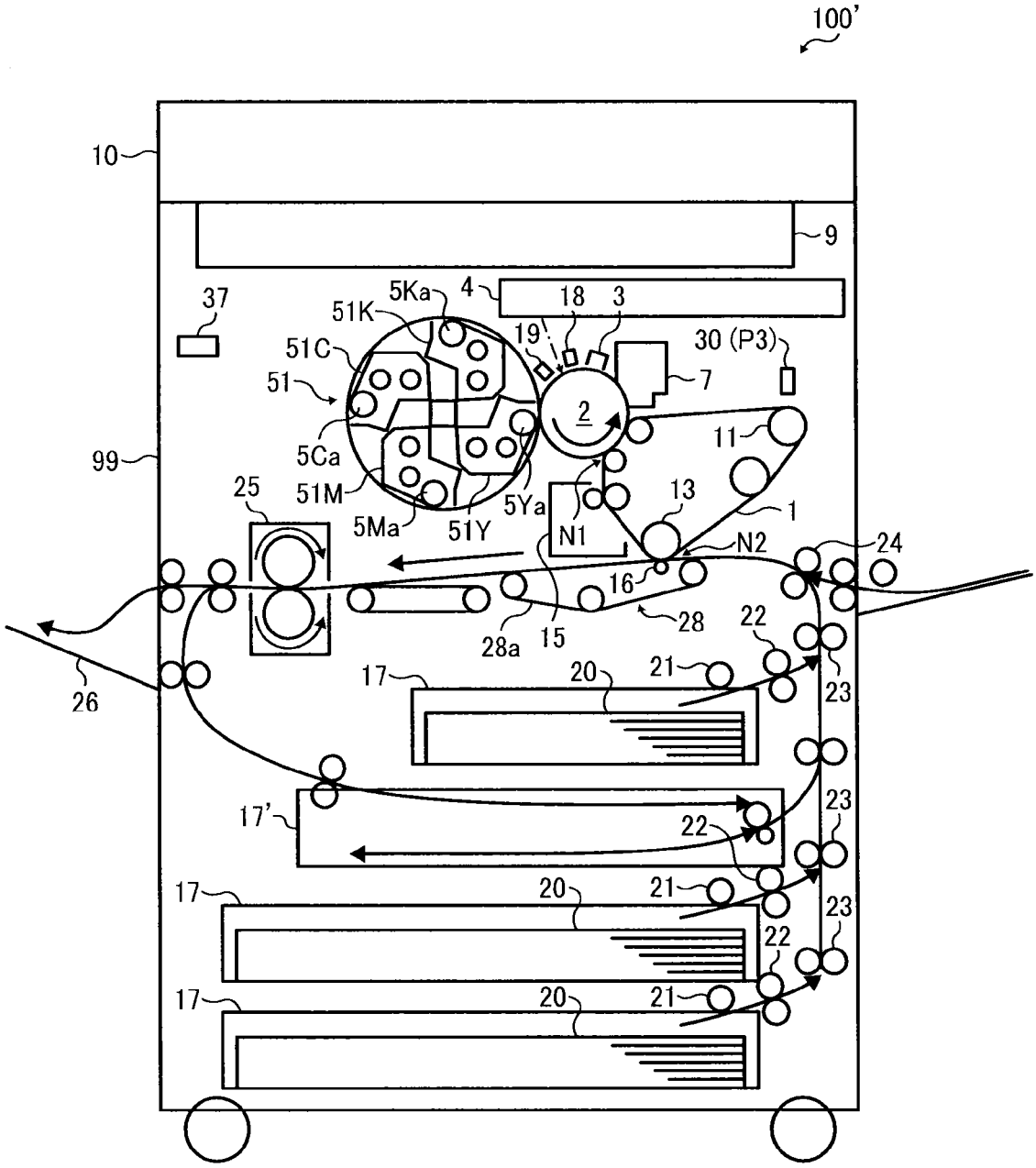
FIG. 2 is a schematic view of another image forming apparatus to which the present invention is applied.

FIG. 2 shows a schematic view of another image forming apparatus to which the present invention may be applied. In FIG. 2, any part or device which is similar to the part or device included in the image forming apparatus 100 as illustrated in FIG. 1 is given a same reference numeral, and a redundant description thereof will be omitted.

An image forming apparatus 100' as illustrated in FIG. 2 shows a full color copier employing one-drum type intermediate transfer method, including a photoreceptor drum 2 as a drum-shaped image carrier and a revolver development unit 51 disposed opposing to the photoreceptor drum 2.

The revolver development unit 51 includes four developing devices 51Y, 51M, 51C, and 51K, each as a developing means, which are held in a holding body rotating about a rotary shaft.

The developing devices 51Y, 51M, 51C, and 51K each develop an electrostatic latent image on the photoreceptor drum 2 by supplying color toner of yellow (Y), magenta (M), cyan (C), and black (K).

When the holding body of the revolver development unit 51 is rotated, an arbitrary developing device among the developing devices 51Y, 51M, 51C, and 51K is moved to a developing position opposed to the photoreceptor drum 2, so that the electrostatic latent image on the photoreceptor drum 2 is developed in a color coincident to the color of the arbitrary developing device. When a full color image is to be formed, for example, each electrostatic latent image for Y, M, C, and K is sequentially formed on the photoreceptor drum 2 while the endless intermediate transfer belt 1 is being rotated substantially four cycles and the electrostatic latent images on the photoreceptor drum 2 are sequentially developed by the developing devices 51Y, 51M, 51C, and 51K for the colors of Y, M, C, and K. Then, the toner images of the colors of Y, M, C, and K formed on the photoreceptor drum 2 are sequentially superimposed on the intermediate transfer belt 1 in the nip N1.

The nip N2 in which a roller 13, a support member of the intermediate transfer belt 1, and the secondary transfer roller 16 of the secondary transfer unit 28 are opposed each other is the secondary transfer nip in which the intermediate transfer belt 1 and a transfer conveyance belt 28*a* of the secondary transfer unit 28 contact each other with a predetermined nip width. When the 4-color superimposed toner image on the intermediate transfer belt 1 as described above passes the nip N2, the 4-color superimposed toner image on the intermediate transfer belt 1 is transferred en bloc onto the recording sheet 20 which has been conveyed by a transfer conveyance belt 28*a* of the secondary transfer unit 28 at an appropriate timing in sync with the passing of the 4-color superimposed toner image.

When images are to be formed on both sides of the recording sheet 20, the recording sheet 20 which has passed the fixing unit 25 is conveyed to a duplex print unit 17', the recording sheet 20 of which surface is reversed is re-fed to the nip N2, and the 4-color superimposed toner image on the intermediate transfer belt 1 is transferred en bloc on the reversed surface thereof as a secondary transfer.

In the image forming apparatus 100' as illustrated in FIG. 2, the toner image sensor 30 is disposed at a position P3 before the secondary transfer which is a position opposed to the part of the intermediate transfer belt 1 wound around the roller 11.

Figure 3:
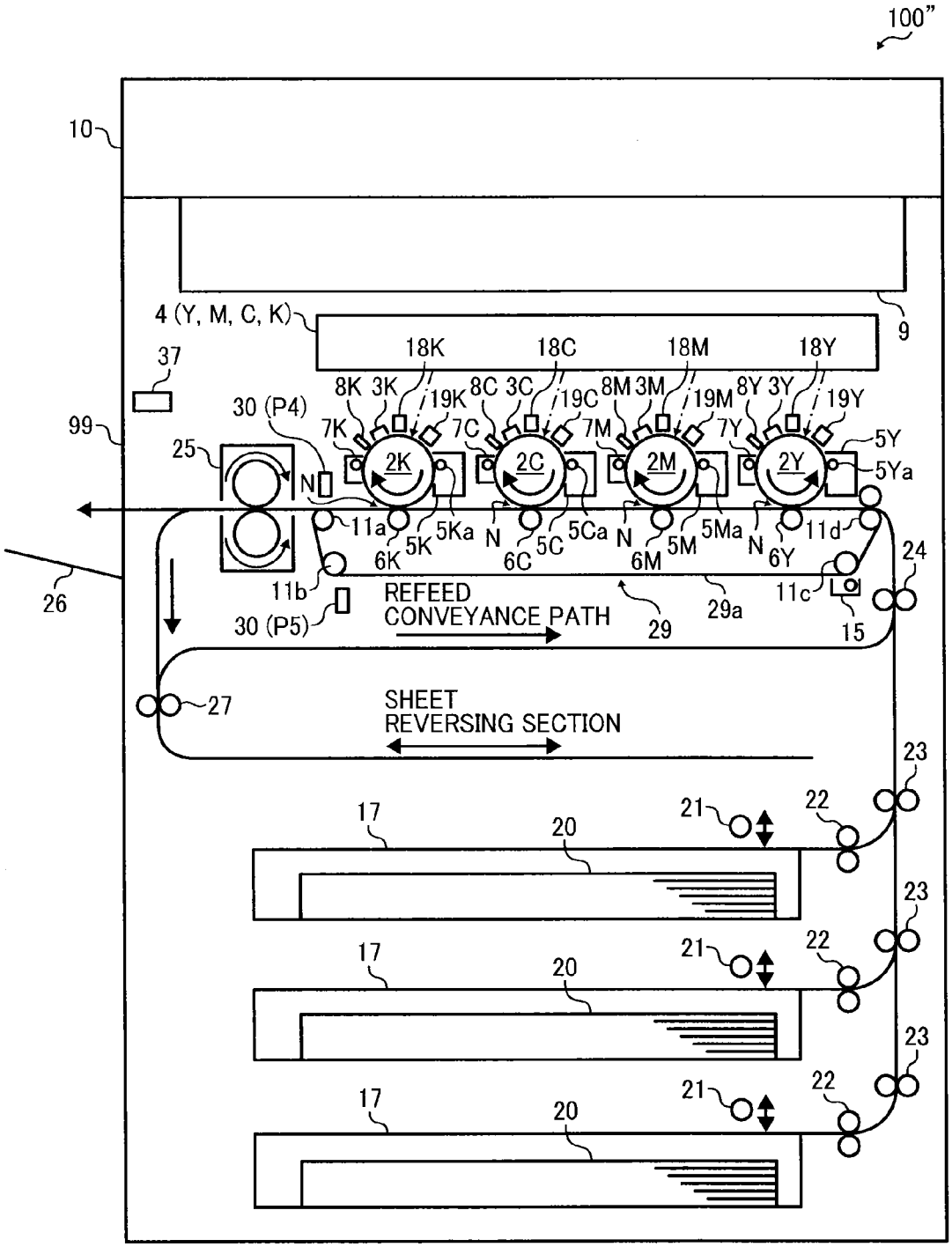
FIG. 3 is a schematic view of further another image forming apparatus to which the present invention is applied.

FIG. 3 shows a schematic view of an image forming apparatus illustrating further another embodiment of the present invention. In FIG. 3, any part or device which is similar to the part or device included in the image forming apparatus 100 as illustrated in FIG. 1 is given waiting time reference numeral, and a redundant description thereof will be omitted.

An image forming apparatus 100" as illustrated in FIG. 3 represents a full color copier employing 4-storied tandem direct transfer method, including a transfer unit 29 disposed below four sets of image forming stations and configured to transfer a toner image formed on the photoreceptor drums 2Y, 2M, 2C, and 2K onto the recording sheet 20. The transfer unit 29 includes an endless transfer belt 29*a* rotatably supported by rollers 11*a* to 11*d*, a plurality of support members. Specifically, the transfer belt 29*a* is wound around a drive roller 11*a* and driven rollers 11*b* to 11*d*, is driven to rotate counterclockwise at a predetermined timing, and passes transfer positions N of each of the image forming stations while carrying the recording sheet 20 thereon.

Transfer rollers 6Y, 6M, 6C, and 6K disposed on an interior surface of the transfer belt 29*a* each transfer a toner image formed on each photoreceptor drum 2Y, 2M, 2C, or 2K at each transfer position N onto the recording sheet 20 by applying a transfer electric potential.

In the image forming apparatus 100" as illustrated in FIG. 3, when a full color mode in which 4-color superimposed image is to be formed is selected on a control panel, not shown, an image formation process in which a toner image of each color of Y, M, C, or K is formed on each of the photoreceptor drums 2Y, 2M, 2C, and 2K, that is, image forming stations of each color, is performed in sync with a conveyance of the recording sheet 20.

Meanwhile, the recording sheet 20 fed out from the sheet feed tray 17 is sent out by the registration roller pair 24 at a predetermined timing, is carried by the transfer belt 29*a*, and is conveyed to pass the transfer position N of each image forming station. The recording sheet 20 onto which a full color toner image has been transferred and a 4-color superimposed toner image is formed thereon is subjected to fixation by the fixing unit 25. The recording sheet 20 is then discharged onto the sheet discharge tray 26.

In the image forming apparatus 100" as illustrated in FIG. 3, the toner image sensor 30 is disposed at a position P4, before the fixation, which is a position most downstream of the transfer unit 29 in the recording sheet conveyance direction and opposed to the part of the intermediate transfer belt 29*a* wound around the roller 11*a*.

In each of the image forming apparatuses 100, 100', and 100", as illustrated in FIGS. 1 to 3, respectively, because the image pattern toner image for correction control is formed on the photoreceptor drums 2Y, 2M, 2C, and 2K or the photoreceptor drum 2 and is transferred to the intermediate transfer belt 1 or the transfer belt 28*a* or 29*a*, the toner image sensor 30 can be so disposed as to be opposed to each of the photoreceptor drums 2Y, 2M, 2C, and 2K or the surface of the photoreceptor drum 2. The mounting position of the toner image sensor 30 in this case is between the developing position by the developing units 5Y, 5M, 5C, and 5K or the revolver development unit 51 and the nip N1 or the transfer position N as a transfer position to the intermediate transfer belt 1 or the transfer conveyance belt 28*a* or 29*a*.

Concerning the thus-configured image forming apparatuses 100, 100', and 100", how to control correction of the image density fluctuation will now be described based on the detection result of the density in the image pattern. In the correction control of the image density, a so-called pattern image is formed and the formed pattern image is adjusted using the image density of the formed pattern image by a designation of a user, thereby improving a quality of the image formed. In the description below, a case applying to the image forming apparatus 100 will be described, which can be similarly applied to the image forming apparatuses 100' and 100".

Figure 4:
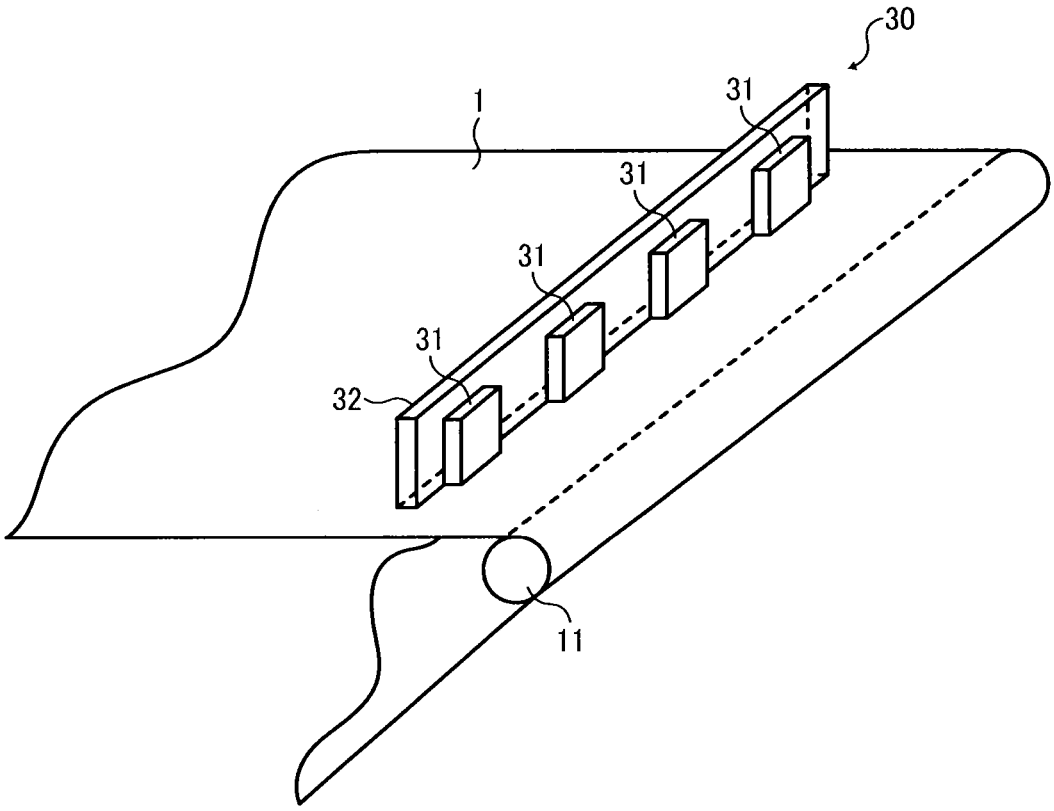
FIG. 4 is an oblique view of an image density detector disposed in the image forming apparatus of FIG. 1.

FIG. 4 is a partial oblique view illustrating the toner image sensor 30. FIG. 4 shows an example of the toner image sensor 30 disposed at the position P1 before the secondary transfer in the image forming apparatus 100. The toner image sensor 30 includes a sensor substrate 32 and four sensor heads 31 as optical sensors to detect a density of an image, that is, a four-head type toner image sensor 30. Accordingly, each sensor head 31 is disposed along a main scanning direction perpendicular to the sheet conveyance direction of the recording sheet 20, that is, along a shaft direction of the photoreceptor drums 2Y, 2M, 2C, and 2K.

With such a configuration, a toner adhering amount at four positions can be measured simultaneously, so that each sensor head 31 can be used exclusively for each color. The number of the sensor heads is not limited to only four and the toner image sensor 30 may be configured to include three sensor heads or five or more sensor heads.

Each sensor head 31 configured to detect the surface of the intermediate transfer belt 1 is disposed opposed to the intermediate transfer belt 1, as a detection target, across a gap of approximately 5 mm with respect to the surface of the intermediate transfer belt 1. In the present embodiment, the toner image sensor 30 is disposed in the vicinity of the intermediate transfer belt 1 and image formation conditions are defined based on the toner adhering amount on the intermediate transfer belt 1 and image forming timing is defined based on the toner adhering position on the intermediate transfer belt 1. However, the toner image sensor 30 may be disposed opposed to the photoreceptor drums 2Y, 2M, 2C, and 2K, or may be disposed at a position opposed to the transfer conveyance belt 28*a* as illustrated in FIG. 2 so as to be opposed to the recording sheet 20 on which the toner image is transferred from the intermediate transfer belt 1.

When the toner image sensor 30 is disposed opposed to the photoreceptor drums 2Y, 2M, 2C, and 2K, the toner image sensor 30 should be opposed to the photoreceptor drums 2Y, 2M, 2C, and 2K at a position downstream of the developing position and upstream of the transfer position in the rotation direction of the photoreceptor drums 2Y, 2M, 2C, and 2K.

Output from the toner image sensor 30 is converted into a toner adhering amount via the adhering amount conversion algorithm exerted by the controller 37, which can store the obtained amount in the nonvolatile memory or volatile memory included in the controller 37 as an image density. Therefore, the controller 37 serves as an image density storage device. The controller 37 serving as the image density storage device stores the image density as chronological data. Any known adhering amount conversion algorithm will suffice.

The nonvolatile or volatile memory included in the controller 37 further includes outputs and correction data as well as control results from various sensors such as surface potential sensors 19Y, 19C, 19M, and 19K and the photo interrupters 18Y, 18C, 18M, and 18K. The controller 37 stores the surface potential readings detected by the surface potential sensors 19Y, 19C, 19M, and 19K, and therefore, serves as a surface potential data storage device. The controller 37 stores the rotational position data of the photoreceptor drums 2Y, 2M, 2C, and 2K detected by the photo interrupters 18Y, 18C, 18M, and 18K, and therefore, serves as a rotational position data storage device. The controller 37 serving as the surface potential data storage device stores the surface potential as a chronological data.

Figure 5A:
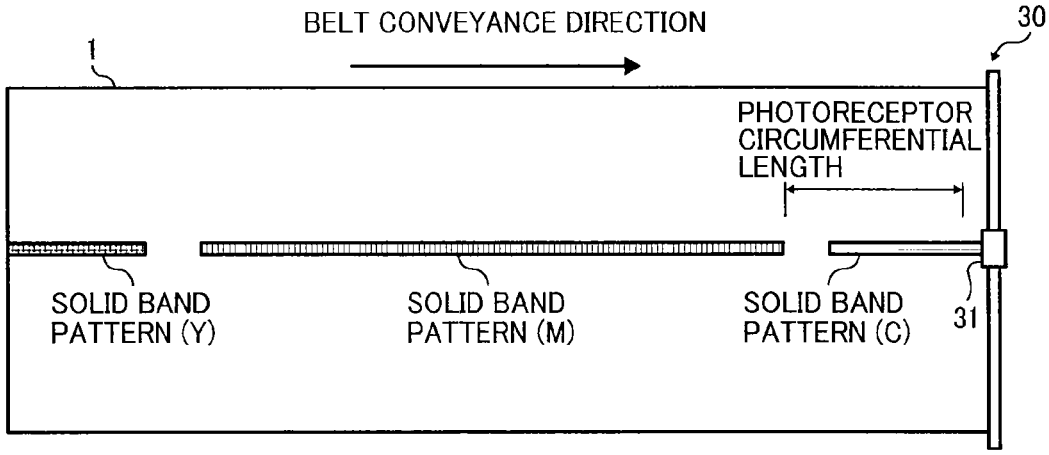
FIGS. 5A and 5B show image patterns of which density is detected by an image density detector.
Figure 5B:
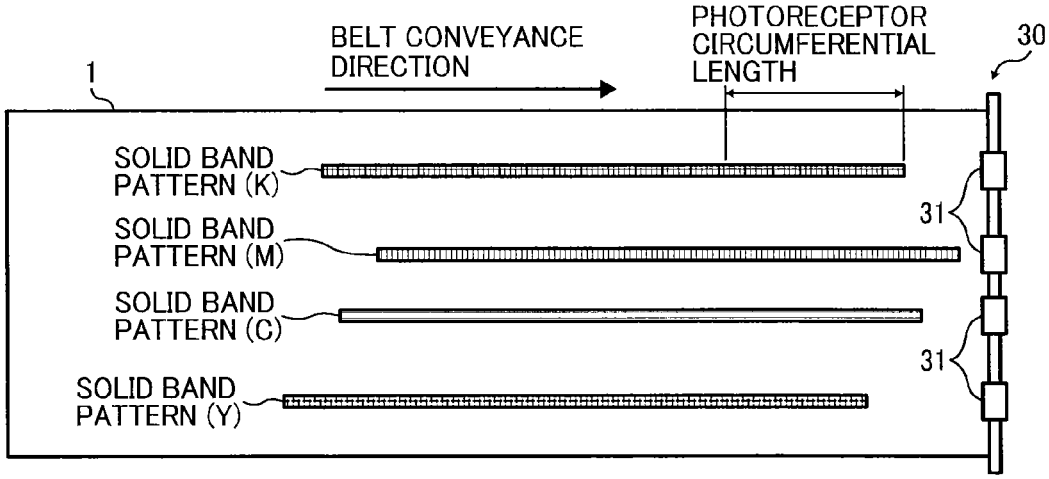

As illustrated in FIGS. 5A and 5B, the pattern image is formed as a solid image with a high image density in the present embodiment for each color of yellow, cyan, magenta, and black. This is because the image density fluctuation can be detected more accurately when the pattern image has a higher density. In addition, as a high density pattern image, the solid image is typical. The pattern image in the present embodiment is represented by a solid image; however, as long as the image density fluctuation can be detected, a less density image can be used. The image pattern for each color is formed in a similar shape.

The pattern image is formed in a long band pattern along a sub-scanning direction corresponding to the lateral direction as illustrated in FIGS. 5A and 5B, i.e., along the rotation direction of the photoreceptor drums 2Y, 2M, 2C, and 2K. The length of the pattern image in the sub-scanning direction corresponds to at least one cycle of the circumferential length of the photoreceptor drums 2Y, 2M, 2C, and 2K, and includes three-cycle length in the present embodiment. This is because the image density adjustment in the image forming apparatus 100 can be performed to minimize the fluctuation in the development gap, that is, the interval between the photoreceptor drums 2Y, 2M, 2C, and 2K and the developing rollers 5Ya, 5Ca, 5Ma, and 5Ka, and to minimize the image density fluctuation based on the uneven sensitivity of the photoreceptor drums 2Y, 2M, 2C, and 2K.

Hereinafter, how to adjust the image density will be described in detail.

A rotary oscillation of the photoreceptor drums 2Y, 2M, 2C, and 2K is one of the factors for the fluctuation in the development gap. As a cause of the rotary oscillation, for example, eccentricity of the rotary center position of the photoreceptor drums 2Y, 2M, 2C, and 2K is raised. Accordingly, the image density fluctuation based on the fluctuation of the development gap includes a rotary fluctuation component as a component generated in accordance with the rotary cycles of the photoreceptor drums 2Y, 2M, 2C, and 2K. In order to detect this component, a length corresponding to at least one circumferential length of each of the photoreceptor drums 2Y, 2M, 2C, and 2K is required as a length of the pattern image in the sub-scanning direction.

In addition, to detect the uneven sensitivity of the photoreceptor drums 2Y, 2M, 2C, and 2K, the surface potential of the photoreceptor drums 2Y, 2M, 2C, and 2K at a time of the pattern image formation needs to be detected. For this reason also, a length corresponding to at least one circumferential length of each of the photoreceptor drums 2Y, 2M, 2C, and 2K is required as a length of the pattern image in the sub-scanning direction.

In FIG. 5A, the solid band pattern of each color is formed in the same position in the main scanning direction corresponding to a vertical direction in the figure and in the direction perpendicular to the sub-scanning direction. This position corresponds to a detection area of the toner image sensor 30 in the main scanning direction, that is, the position at which the sensor head 31 is disposed. This position is at a center in the main scanning direction in FIG. 5A; however, the disposed position may be at an end in the main scanning direction.

In contrast, FIG. 5B shows that the solid band patterns of each color are formed at different positions each other in the main scanning direction. This position corresponds to a detection area of the toner image sensor 30 in the main scanning direction, that is, the position at which the sensor head 31 is disposed.

If the image pattern is formed as illustrated in FIG. 5A, the number of the sensor heads 31 to detect the image density is only one, which is an advantage. If the image pattern is formed as illustrated in FIG. 5B, there is an advantage that the time to complete detection of the image density is short because the image patterns of each color overlap.

As described heretofore, the toner image sensor 30 is formed to each of the photoreceptor drums 2Y, 2M, 2C, and 2K so as to detect the image density on the photoreceptor drums 2Y, 2M, 2C, and 2K. By configuring as above, influence of the fluctuation in the move of the intermediate transfer belt 1 can be avoided. Further, the toner image sensor 30 may be disposed so as to be opposed to the recording sheet 20 on which the toner image is transferred from the intermediate transfer belt 1 so that the toner image sensor 30 can detect the density of the image formed on the recording sheet 20. By configuring as above, influence caused by the fluctuation in the move of the recording sheet 20 can be avoided.

When detecting the above components included in the image density fluctuation, following image forming conditions in forming the pattern image are kept constant. Such conditions includes, for example, charging conditions by the chargers 3Y, 3C, 3M, and 3K, exposure conditions or writing conditions of the optical write units 4Y, 4M, 4C, and 4K, developing conditions of the developing units 5Y, 5M, 5C, and 5K, and transfer conditions of the primary transfer rollers 6Y, 6C, 6M, and 6K.

As a charging condition, a charging bias is included; as a writing condition, strength of the writing beam is included; as a developing condition, a developing bias is included; and as a transfer condition, a transfer bias is included.

Figure 10:
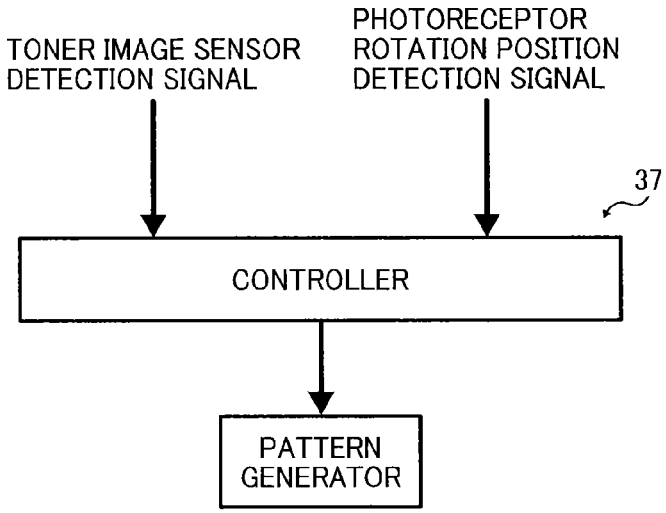
FIG. 10 is a schematic control block diagram in which an image pattern is formed based on the signals from the image density detector and the rotational position detector.

Herein, the chargers 3Y, 3C, 3M, and 3K, the optical write units 4Y, 4M, 4C, and 4K, the developing units 5Y, 5M, 5C, and 5K, and the primary transfer rollers 6Y, 6C, 6M, and 6K each perform a series of image forming processes of an electrophotographic image forming apparatus including development, charging, exposure, and the like, in forming image patterns, and therefore, each serves as a pattern generator (see FIG. 10).

Without fluctuation in the development gap and the uneven sensitivity of the photoreceptor drums 2Y, 2M, 2C, and 2K, if the solid image is formed while keeping the image forming conditions constant, the image density becomes uniform. However, even though the solid image is formed keeping the image forming conditions constant, the image density fluctuates in actuality due to the fluctuation in the development gap and the uneven sensitivity of the photoreceptor drums 2Y, 2M, 2C, and 2K.

The image density fluctuation can be detected by the toner image sensor 30 detecting the image density of the solid image formed in a long band pattern in the sub-scanning direction. Specifically, the detection signal of the toner image sensor 30 is input to the controller 37 as a chronological data and the controller 37 recognizes the toner adhering amount in the chronological order. The toner adhering amount is then stored as chronological image density data by the function of the controller as the image density data storage device.

The controller 37 serving as the image density data storage device relates the image density with a phase of the photoreceptor drums 2Y, 2M, 2C, and 2K based on the signals from the photo interrupters 18Y, 18C, 18M, and 18K. The controller 37 performs an averaging process to the image density by the rotation cycle of the photoreceptor drums 2Y, 2M, 2C, and 2K. Thus, the image density related to the phase of the photoreceptor drums 2Y, 2M, 2C, and 2K can be obtained and stored (which corresponds to f(t), to be described later).

The image density fluctuates due to not only the development gap fluctuation but the uneven sensitivity of the photoreceptor drums 2Y, 2M, 2C, and 2K. When the sensitivity of the photoreceptor drums 2Y, 2M, 2C, and 2K responsive to the exposure fluctuates due to factors such as an environmental change or aging deterioration, even though the exposure is performed at a constant exposure amount, the potential after the exposure of the photoreceptor drums 2Y, 2M, 2C, and 2K fluctuates and the resultant electric field changes, so that the density fluctuation occurs.

In the image forming apparatus 100, the uneven sensitivity can be detected by detecting a potential of the electrostatic latent image on the photoreceptor drums 2Y, 2M, 2C, and 2K written by the optical write units 4Y, 4M, 4C, and 4K, that is, a surface potential of the photoreceptor drums 2Y, 2M, 2C, and 2K before being supplied with toner and developed by the developing units 5Y, 5M, 5C, and 5K.

Specifically, the detection signal of the surface potential sensors 19Y, 19C, 19M, and 19K is input to the controller 37 as chronological data, the controller 37 recognizes the surface potential in the chronological order, and stores the surface potential in the chronological order as a surface potential data storage device.

The controller 37 serving as the surface potential storage device relates the image density with a phase of the photoreceptor drums 2Y, 2M, 2C, and 2K based on the signals from the photo interrupters 18Y, 18C, 18M, and 18K. The controller 37 performs averaging process to the surface potential by the rotation cycle of the photoreceptor drums 2Y, 2M, 2C, and 2K. Thus, the surface potential related to the phase of the photoreceptor drums 2Y, 2M, 2C, and 2K can be obtained and stored (which corresponds to Vout(t), to be described later).

As described above, the image density fluctuates due to the development gap fluctuation and the uneven sensitivity of the photoreceptor drums 2Y, 2M, 2C, and 2K. Then, the image density fluctuation is formed caused by superimposition of the above factors.

Figure 6:
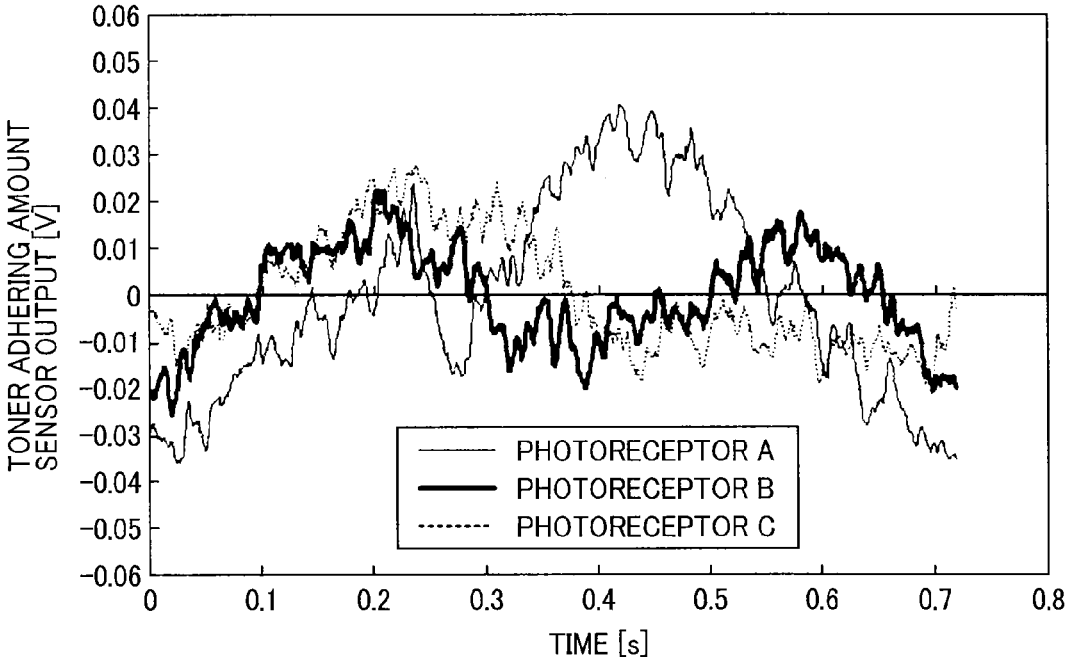
FIG. 6 is a graph illustrating an example of density fluctuation.
Figure 7:
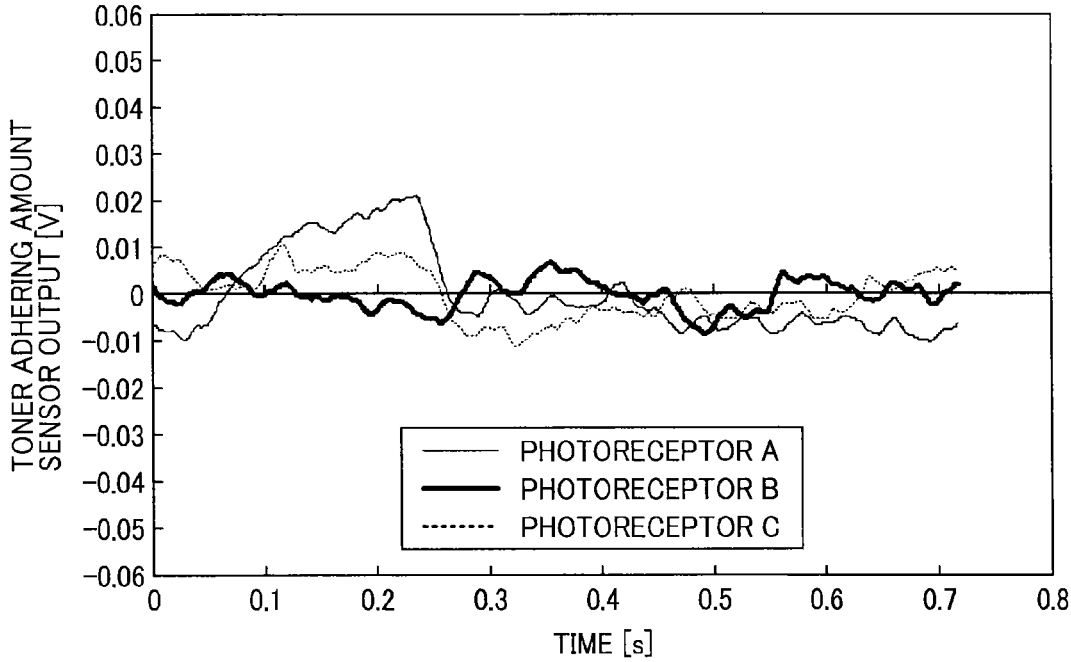
FIG. 7 is a graph illustrating an uneven sensitivity component of an image carrier included in the density fluctuation of FIG. 6.
Figure 8:
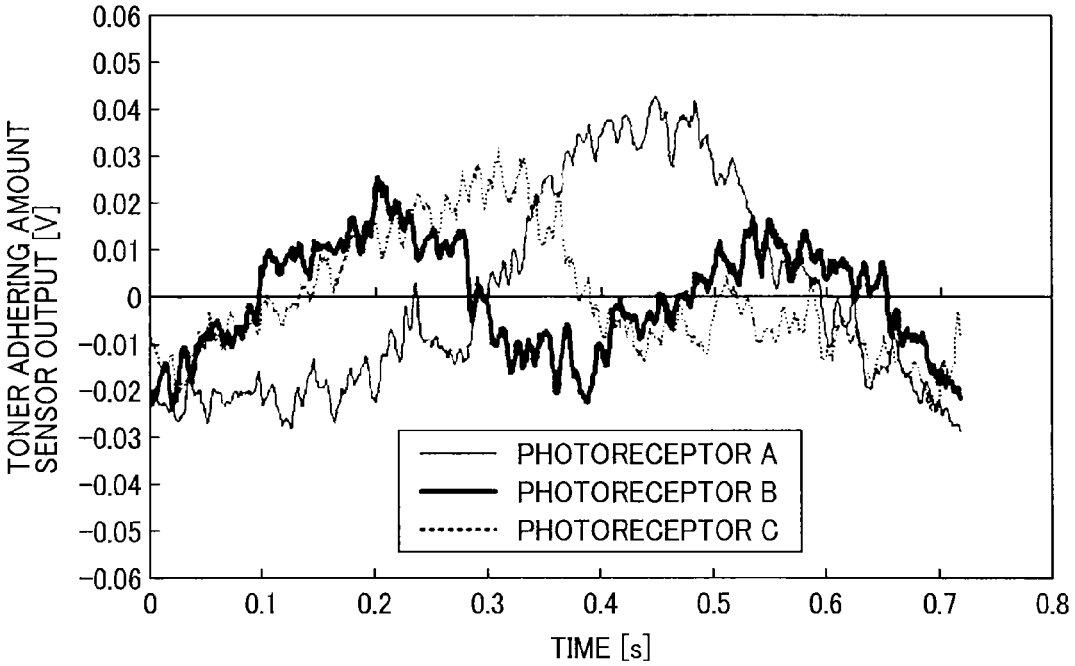
FIG. 8 is a graph illustrating a rotary oscillation component of an image carrier included in the density fluctuation of FIG. 6.

FIGS. 6 to 8 show data obtained from experiments using the averaging process described above.

The diameter of the photoreceptor used in the present experiment is $\phi$100 mm, process linear speed is 440 mm/s, and each charging, developing, and LD power is set to −700V, −500V, and 70% on the maximum lighting time per dot, respectively, and a belt-shaped pattern of cyan 100% was formed. In the conditions above, the density fluctuations of three different photoreceptors A, B, and C are measured.

FIG. 6 shows that the obtained density fluctuations for each photoreceptor are different in shape from each other.

Using the potential sensor output in forming the image pattern for measuring the density fluctuation as illustrated in FIG. 6, the obtained shape of the density fluctuation in the measurement was decomposed into an uneven sensitivity component and a rotary oscillation component as in FIG. 7 and FIG. 8, respectively.

FIG. 7 shows a density fluctuation due to the photoreceptor uneven sensitivity, which is obtained in such a manner that: the potential sensor output when forming a band-like pattern with 100% of image density is superimposed by a suitable gain (i.e., an adjustment gain which will be described later, corresponding to 1:A), and the obtained result is converted into the density fluctuation of the toner adhering amount sensor output by each photoreceptor cycle.

FIG. 8 shows the density fluctuation caused by the rotary oscillation of the photoreceptor, of which data is obtained from the measurement data in FIG. 6 and the data in FIG. 7 (corresponding to fg(t), which will be described later). Because the phase is determining a physical, positional relation between the photoreceptor and the developing roller, the inventors of the present invention confirmed that the phase does not fluctuate due to the environmental change and the chronological factor.

By comparing FIG. 8 with FIG. 6, it can be seen that the waveforms are substantially coincident as to all photoreceptor A, B, and C. That is, it can be seen that the photoreceptor rotary oscillation is a main cause of the density fluctuation. More specifically, the photoreceptor uneven sensitivity component in FIG. 7 is one cause of the density fluctuation but is less influential compared to the photoreceptor rotary oscillation.

As a result, the inventors have developed a correction technology to reduce the density fluctuation occurring due to the rotary cycle of the image carrier, that is, how to generate correction data of the photoreceptor cycle from the rotary oscillation component of the photoreceptor.

According to the present control method, once the rotary oscillation component is obtained when installing the image forming apparatus, the control effect continues as long as the photoreceptor condition does not change in the attach-/detach-/replacement operation. Such a control table to remove the influence of the uneven sensitivity with respect to the image density may be generated at a time of attachment or detachment of the image forming unit, with no need of generating such a table in other occasions.

As image forming conditions, there are a charging condition, an exposure condition, a developing condition, and a transfer condition. In the present embodiment, the developing condition is defined as a first condition to be controlled, and the first image forming means is implemented by the developing units 5Y, 5M, 5C, and 5K.

Because the developing condition is, compared to other conditions, highly sensitive to the adjustment of the image density, it is selected as the first condition. Alternatively or in addition to the developing condition, the exposure condition may be selected as a first parameter, because the exposure condition is also highly sensitive to the image density adjustment. In this meaning, the developing units 5Y, 5M, 5C, and 5K and/or the optical write units 4Y, 4M, 4C, and 4K function as the first image forming means.

In performing the first image forming operation, the controller 37 serves as a first image forming condition determining means to determine a specific first condition on the developing condition in order to adjust a density of the image based on a potential distribution of the surface potential of at least one circumferential length of the photoreceptor drums 2Y, 2M, 2C, and 2K detected by the surface potential sensors 19Y, 19C, 19M, and 19K; and a density fluctuation of the pattern image of at least one circumferential length of the photoreceptor drums 2Y, 2M, 2C, and 2K detected by the toner image sensor 30.

The controller 37 functioning as the first image forming condition determining means detects a density fluctuation of the pattern image with the toner image sensor 30 when the rotational position of the photoreceptor drums 2Y, 2M, 2C, and 2K change; based on the potential distribution of the surface potential detected by the surface potential sensors 19Y, 19C, 19M, and 19K when forming the pattern image and the density fluctuation, extracts an image density fluctuation due to the rotary fluctuation component constituting the developing gap fluctuation component of the photoreceptor drums 2Y, 2M, 2C, and 2K among density fluctuations; and determines the first condition so as to minimize the extracted fluctuation.

The potential distribution of the surface potential of at least one circumferential length of the photoreceptor drums 40Y, 40C, 40M, and 40K detected by the surface potential sensors 19Y, 19C, 19M, and 19K, respectively, is to be coincident to an area to form the pattern image that the toner image sensor 30 detects.

The controller 37 functioning as the first image forming condition determining means obtains the potential distribution of the exposed area on which the pattern image is to be formed, and determines the first condition by a calculation using the obtained potential distribution.

The first condition as to the developing condition is a developing bias. A developing condition other than the developing bias may be used as long as it can adjust a density of the image. The first condition when the exposure condition is most important is exposure strength, i.e., exposure power.

The developing units 5Y, 5M, 5C, and 5K operate in accordance with the thus-determined first condition. This operation is controlled by the controller 37. Therefore, the controller 37 functions as a first control means.

Herein, a case when the rotational position of the photoreceptor drums 2Y, 2M, 2C, and 2K changes is at least one of when the photoreceptor drums 2Y, 2M, 2C, and 2K are initially installed, replaced, and detached. When the rotational position of each of the photoreceptor drums 2Y, 2M, 2C, and 2K changes, the density fluctuation occurring pattern changes due to a change in the developing gap, as illustrated in the waveforms of FIG. 8. Therefore, a profile being a control table to control the density fluctuation, i.e., the developing condition needs to be changed.

Specifically, because there is a higher possibility that the image density fluctuation occurring status per photoreceptor cycle changes, determination of the image formation or formation or revision of the control table is performed when the image carrier is removed mechanically such as immediately after the image carrier is initially set, replaced, or disengaged. Other reason is because the positional relation between the photoreceptor and a home position sensor, i.e., each of the photo interrupters 18Y, 18C, 18M, and 18K is shifted.

Originally, when the image carrier without a control table is initially set, the control table for use in controlling a series of corrections needs to be created. When the photoreceptor is replaced, a new control table needs to be produced for a new photoreceptor because there is a difference between the old and new photoreceptors such as a rotation characteristic and photosensitivity fluctuation. Further, even when the photoreceptor is simply disengaged for the maintenance, the control table needs to be reproduced because there is a possibility that the mounting status of the photoreceptor due to the disengagement of the photoreceptor changes and that the axis of the photoreceptor and the rotary axis deviate each other, and because there is a difference in the positional relation between the position of the photoreceptor related to a rotation characteristic and photosensitivity fluctuation and the photoreceptor home position sensor. Due to above reasons, the image forming condition needs to be determined and the control table needs to be created or revised immediately when the image carrier is set.

However, as described above, the image density changes by not only the fluctuation of the development gap but the environmental change inside the main body 99 of the image forming apparatus such as a use environment change of the image forming apparatus 100 when image formation has been performed for a certain number of times, leading to a uneven sensitivity of the photoreceptor drums 2Y, 2M, 2C, and 2K. Specifically, when the sensitivity of the photoreceptor drums 2Y, 2M, 2C, and 2K responsive to the exposure fluctuates due to factors such as aging deterioration or an environmental change, even though the exposure is performed at a constant exposure amount, the potential after the exposure of the photoreceptor drums 2Y, 2M, 2C, and 2K fluctuates and the resultant electric field changes, so that the density fluctuation occurs.

In this case, at a timing when the image forming operation has been done for a certain number of times after the rotational position of the photoreceptor drums 2Y, 2M, 2C, and 2K could have changed or when the environmental change occurs in the main body 99 due to the change of the use environment of the image forming apparatus 100, the surface potential of the photoreceptor drums 2Y, 2M, 2C, and 2K can be detected by the surface potential sensors 19Y, 19C, 19M, and 19K, respectively so that the first condition can be renewed. As a result, the density fluctuation due to the uneven sensitivity can be minimized. The detection of the surface potential can be performed at a time, for example, when the image formation instructed by the user is not being performed, by similarly generating the pattern image as described above. Alternatively, the first condition can be renewed by using a high density image when the image formed by the user's instruction includes a uniform, high density image having a length longer than the circumferential length of the photoreceptor. This is applied similarly to a second condition, which will be described later.

As described above, the uneven sensitivity of the photoreceptor drums 2Y, 2M, 2C, and 2K occurs due to not only the aging deterioration or environmental change such as when the environmental condition in the main body 99 changes with the change of use environment of the image forming apparatus 100 after image forming operation of a certain number of times, but a sensitivity change of the photoreceptor drums 2Y, 2M, 2C, and 2K in accordance with the image density.

That is, due to the fluctuation of the image density, the type of the potential difference determining the sensitivity of the photoreceptor drums 2Y, 2M, 2C, and 2K as to the toner adhering amount changes, thereby occurring the sensitivity change in the photoreceptor drums 2Y, 2M, 2C, and 2K. Specifically, in the shadow portion that is a high density portion such as a solid image with a high toner adhering amount, the difference in the potential between the exposed bright area potential and the developing bias, that is, the developing potential becomes a dominant factor. By contrast, in a halftone or highlight image with a less toner adhering amount than that of the shadow portion, the difference in the potential between the dark area potential being the potential of a non-exposed portion of the photoreceptor drums 2Y, 2M, 2C, and 2K and the developing bias, i.e., a background potential is a dominant factor.

As described above, the fluctuation of the image with a high density to which the developing potential is dominant is minimized using the first condition such as the developing bias.

The fluctuation of the halftone or highlight image to which the background potential is dominant needs to be minimized using a condition different from the first condition. As the second condition other than the first condition, charging condition is effective to control the background potential among various factors for forming images.

Then, in the present embodiment, the charging condition, i.e., the charging bias is used as the second condition. The charging condition other than the charging bias may be used as long as it can adjust a density of the image.

In addition, because the image density area in which the background potential to be controlled by the charging condition is dominant is the halftone or highlight portion, the image density area controlled by the developing condition is a high density area and the image pattern is formed with a high density, and that the area with a less density than the high density area is also needs to be controlled, the second condition is determined to correct the density fluctuation of the image having a lower density than that of the image pattern.

If correction as to the uneven sensitivity due to the sensitivity change of the photoreceptor drums 2Y, 2M, 2C, and 2K in accordance with the image density is not considered, a relation between the image density as a correction target of which density fluctuation is to be corrected by the first condition and the image density as a correction target of which density fluctuation is to be corrected by the second condition may be inverse, that is, the image density to be corrected by the first condition may be lower than that to be corrected by the second condition.

Then, in the present embodiment, the charging condition, more specifically, the charging bias is used as the second condition. In the present embodiment, the charging condition is defined as a second condition to be controlled, and the second image forming means which can adjust the image density is implemented by the chargers 3Y, 3C, 3M, and 3K.

In performing the second condition control, the controller 37 serves as a second image forming condition determining means to determine a specific second condition on the charging condition in order to adjust a density of the image based on a potential distribution of the surface potential of at least one circumferential length of the surface potential sensors 19Y, 19C, 19M, and 19K detected by the surface potential sensors 19Y, 19C, 19M, and 19K; and a density fluctuation of the pattern image of at least one circumferential length of the photoreceptor drums 2Y, 2M, 2C, and 2K detected by the toner image sensor 30.

The controller 27 functioning as the second image forming condition determining means detects a density fluctuation of the pattern image with the toner image sensor 30 when the rotational position of the photoreceptor drums 2Y, 2M, 2C, and 2K changes; based on the potential distribution of the surface potential detected by the surface potential sensors 19Y, 19C, 19M, and 19K when forming the pattern image and the density fluctuation, extracts an image density fluctuation due to the rotary fluctuation component of the photoreceptor drums 2Y, 2M, 2C, and 2K among density fluctuations; and determines the second condition so as to minimize the extracted fluctuation.

The controller 37 functioning as the second image forming condition determining means obtains the potential distribution of the exposed area on which the pattern image is to be formed, and determines the second condition by a calculation using the obtained potential distribution. The above potential distribution data and the density fluctuation data are commonly used as the data for the controller 37, functioning as the first image forming condition determining means, to determine the first condition.

In this case, the second condition is determined by the controller 37, functioning as the second image forming condition determining means, to minimize the density image fluctuation lower than that of the density to be corrected by the first condition.

Accordingly, the density fluctuation of the high density image is controlled by the first control using the first condition and the density fluctuation of the halftone or highlight image of which the density is lower is controlled by using the second control using the second condition. Thus, the second condition is used together with the first condition for changing the developing potential.

When the background potential is changed by the first condition, the second condition needs to be changed. The first condition dominant to the high density image also affects the second condition. Because the density fluctuation is acknowledgeable in the high density image, it is preferable that the first condition is first decided and the second condition be decided next, after considering the effect of the first condition, so that the effect of the first condition may be cancelled.

The effect of the first control to the halftone image or the highlight image can be theoretically easily speculated if the parameter indicating the effect of the first control to the halftone image or the highlight image has been known. Such parameter is herein the first condition, that is, the developing bias, as is clear from the above description. The effect level of the parameter to the halftone image or the highlight image and an adjustment amount of the second condition to be adjusted to cope with the effect level can be obtained by calculation using a tuning (corresponding to each adjustment gain which will be described later) based on the actual measurement.

Thus, the controller 37, functioning as the second image forming condition determining means, determines the second condition so as to adjust to the image density lower than that of the image density to be corrected by the first condition based on the density fluctuation, the potential distribution, and the effect of the first condition to the image density.

Specifically, the controller 37, functioning as the second image forming condition determining means, determines the second condition so as to cancel the effect of the lower density image with a density lower than that of the pattern image so as to adjust to the image density lower than that of the image density to be corrected by the first condition based on the density fluctuation, the potential distribution, and the effect of the first condition to the image density.

The chargers 3Y, 3C, 3M, and 3K operate in accordance the thus-determined second condition in the image formation. This operation is controlled by the controller 37. Therefore, the controller 37 functions as the second control means.

Accordingly, the image formation after the first and second condition determination, the controller 37 functioning as the first and second control means causes to operate the developing units 5Y, 5M, 5C, and 5K in accordance with the first condition determined as above and operate the chargers 3Y, 3C, 3M, and 3K in accordance with the second condition.

Figure 9:
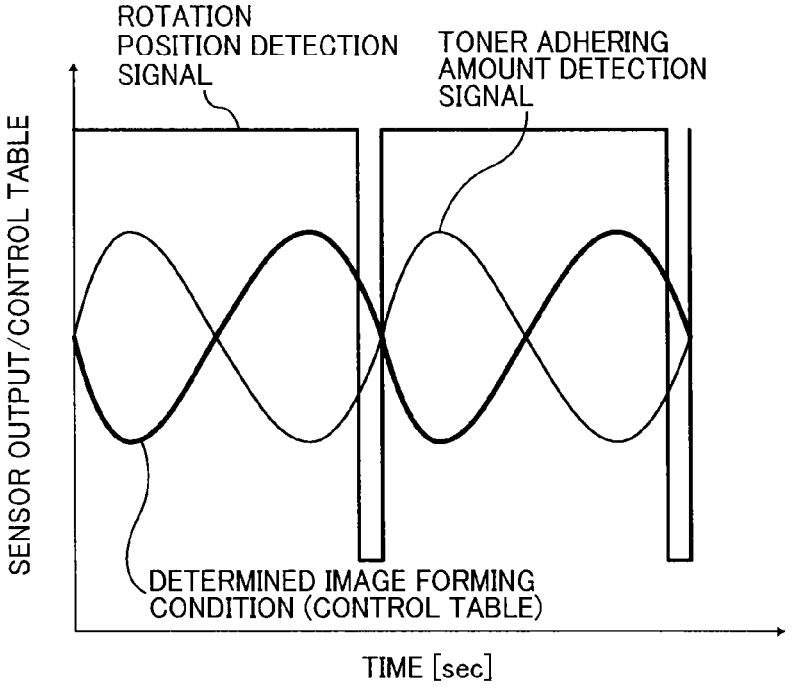
FIG. 9 is a graph illustrating a relation between a rotational position detection signal detected by a rotational position detector, a toner adhering amount detection signal by the image density detector, and an image forming condition generated based on the above signals.

FIG. 9 shows a relation between a rotational position detection signal detected by the photo interrupters 18Y, 18C, 18M, and 18K, a toner adhering amount detection signal by the toner image sensor 30, and the control table as the image forming condition generated based on the above signals. As illustrated in FIG. 9, the graph shows signals of two circumferential cycles of the photoreceptor drums 2Y, 2M, 2C, and 2K.

The superimposed condition based on the first condition and the second condition is represented as a determined image forming condition in FIG. 9.

In addition, the density fluctuation of the pattern image is represented as a toner adhering amount detection signal in FIG. 9.

The toner adhering amount detection signal changes at waiting time cycle with a cycle of the rotational position detection signal. In addition, calculation and determination of the first condition by the controller 37 functioning as the first image forming condition determining means, calculation and determination of the second condition by the controller 37 functioning as the second image forming condition determining means, operation of the developing units 5Y, 5M, 5C, and 5K responsive to the first condition, and operation of the chargers 3Y, 3C, 3M, and 3K responsive to the second condition are performed in synchronization with the rotational position of the photoreceptor drums 2Y, 2M, 2C, and 2K detected by the photo interrupters 18Y, 18C, 18M, and 18K.

The image forming condition based on the first and the second conditions that are superimposed is generated as a chronological data having a density fluctuation cancelling or offsetting waveform. Accordingly, the determined control table for the image forming condition is of an inverse phase to the toner adhering amount detection signal.

Herein, there is a case in which the expression of "inverse phase" is not appropriate because the developing bias or the exposure power, which are used as the first condition for the image density control parameter, and the charging bias used as the second condition for the image density control parameter may include a – (minus) code or may have a reduced adhering amount with a high absolute value. However, the expression of "inverse phase" is used in a meaning that a control table to cancel the adhering amount variation as represented by the toner adhering amount detection signal is to be created, that is, a control table with a reverse phase is to be created.

A gain is a fluctuation amount of the control table in determining the control table with respect to the fluctuation amount [V] of the toner adhering amount detection signal and corresponds to each adjustment gain, which will be described later. The gain can be principally obtained from a theory, but is verified in an actual experiment based on the theoretical value and is obtained finally from the experimental data.

The control table (corresponding to, for example, VB(t) or Vg(t), which will be described later), has a chronological relation as shown in FIG. 9 with the rotational position detection signal. The toner adhering amount detection signal changes in waiting time cycle with a cycle of the rotational position detection signal. In the illustrated example, a head of the control table corresponds to an occurrence of the rotational position detection signal.

Herein, if the control table is the developing bias control table, a timing to apply the control table needs to be determined considering the distance between the development nip and the toner image sensor 30, that is, the distance in which the toner image moves. If such a distance is just an integer multiple of the circumferential length of the photoreceptor, the control table can be applied from the head in sync with the rotational position detection signal. If the distance is not an integer multiple of the circumferential length of the photoreceptor, the control table can be applied by shifting a time period by a shifted distance. Similarly, in using the control table for the exposure power, the control table may be applied considering the distance between the exposure position and the toner image detection sensor 30. Similarly, in using the control table for the charging bias, the control table may be applied considering the distance between the exposure position and the toner image detection sensor 30.

Generation of the image pattern for determining the first and second conditions is based on the rotational position of the photoreceptor drums 2Y, 2M, 2C, and 2K detected by the photo interrupters 18Y, 18C, 18M, and 18K. In an example as illustrated in FIG. 9, the image pattern is generated such that the leading end of the image pattern in the sub-scanning direction is in synchronization with a rising of the rotational position detection signal.

In order to generate the image pattern at a timing as described above, as illustrated in FIG. 10, a detection signal related to a rotational position of the photoreceptor drums 2Y, 2M, 2C, and 2K detected by the photo interrupters 18Y, 18C, 18M, and 18K, respectively, is input to the controller 37, the detection signal is transferred to a pattern generator via the controller 37, and the pattern generation means generates an image pattern based on the input detection signal.

Figure 12:
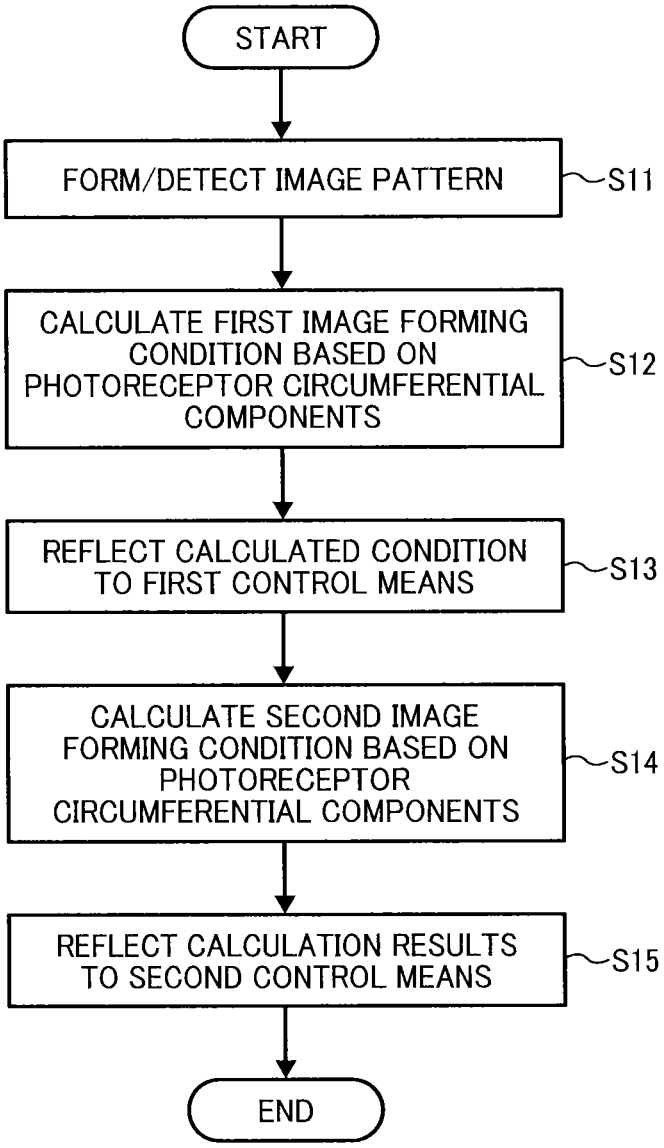
FIG. 12 is a flowchart illustrating a control to minimize the density fluctuation.

In addition, as illustrated in FIG. 10, a detection signal related to the density of the pattern image detected by the toner image sensor 30 is input to the controller 37. When the detection signals are input, a relation between the density fluctuation data detected by the toner image sensor 30 and the rotational position of the photoreceptor drums 2Y, 2M, 2C, and 2K detected by the photo interrupters 18Y, 18C, 18M, and 18K is obtained as illustrated in FIG. 12.

In the CPU of the controller 37, calculation of the image pattern obtained by the toner image sensor 30, more specifically, the averaging process and the like based on the signals of the photo interrupters 18Y, 18C, 18M, and 18K are performed.

Figure 11:
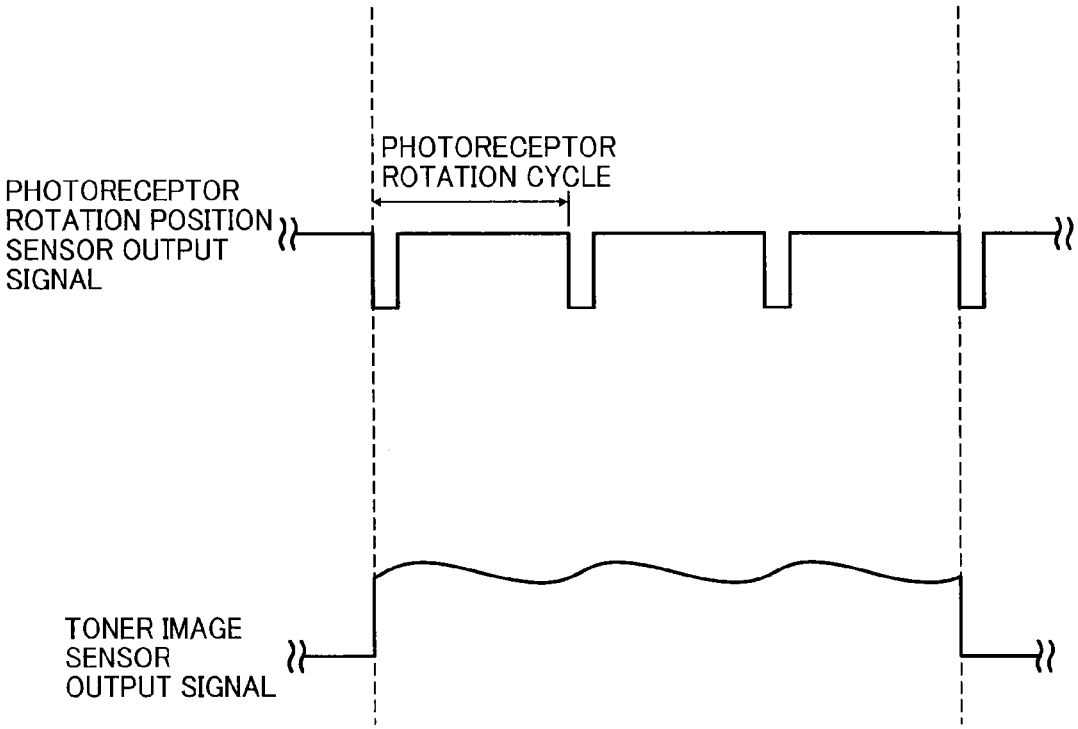
FIG. 11 is a timing chart illustrating a relation between the signals of the image density detector and the rotational position detector.

The pattern writing position of the pattern generator is determined such that the signal of the photo interrupters 18Y, 18C, 18M, and 18K comes at the head of the image pattern as illustrated in FIG. 11.

Specifically, a phase relation between the toner image sensor 30 and the photo interrupters 18Y, 18C, 18M, and 18K is previously obtained, and the exposure start position of the pattern generator is changed so that the signal of the toner image sensor 30 comes at the head of the image pattern. In the present embodiment, it is configured such that the exposure start position by the optical write units 4Y, 4M, 4C, and 4K is determined in sync with the head of the image pattern. However, because the toner adhering amount at the pattern head is not stable, the exposure start position of the optical write units 4Y, 4M, 4C, and 4K can be determined so that the detection signal of the photo interrupters 18Y, 18C, 18M, and 18K comes at a short predetermined distance from the head so that the toner adhering amount becomes stabilized.

In determining the leading end of the image pattern in the sub-scanning direction, following data is required: the rotational position of the photoreceptor drums 2Y, 2M, 2C, and 2K detected by the photo interrupters 18Y, 18C, 18M, and 18K; an interval or layout distance between a position where the electrostatic latent image is formed on the photoreceptor drums 2Y, 2M, 2C, and 2K by the optical write units 4Y, 4M, 4C, and 4K, respectively, that is, the position or the writing position and the detection position by the toner image sensor 30; and a process linear speed in the interval.

These data are stored in the nonvolatile memory or the volatile memory included in the controller 37. The leading end of the image pattern along the sub-scanning direction is determined responsive to all these data.

Herein, the interval means a distance between the write position on the photoreceptor drums 2Y, 2M, 2C, and 2K written by the optical write units 4Y, 4M, 4C, and 4K and the detection position of the image pattern by the toner image sensor 30 in the sub-scanning direction.

In addition, the process linear speed in the interval means a moving speed of the photoreceptor drums 2Y, 2M, 2C, and 2K as a rotary member included in the interval in the sub-scanning direction.

The trailing end position of the image pattern in the sub-scanning direction can also be determined similarly to the case of determining the leading end. Alternatively, the trailing end position can also be determined responsive to the above data even in a case where the leading end is arbitrarily determined.

Specifically, the determination of the leading end and/or the trailing end position responsive to the data may be performed based on the elapsed time period from when the rotational position of the photoreceptor drums 2Y, 2M, 2C, and 2K has been detected by the photo interrupters 18Y, 18C, 18M, and 18K. Alternatively, the trailing end position can also be determined responsive to the above data even in a case where the leading end is arbitrarily determined. However, even in this case, the determination of the leading end or the trailing end position is performed substantially based on the above data. Further optionally, while the write start of the pattern image being arbitrary, the position at which the exposure ends may be determined to be an integral multiple of the circumferential length of the photoreceptor drums 2Y, 2M, 2C, and 2K.

The elapsed time period can be measured for example by the CPU of the controller 37. In the measurement, the controller 37 functions as a timer.

Thus, the relation between each timing as illustrated in FIG. 9 can be obtained and the generation of the pattern image is performed in sync with the rotational position of the photoreceptor drums 2Y, 2M, 2C, and 2K detected by the photo interrupters 18Y, 18C, 18M, and 18K.

Because the interval of the image pattern for each color is different from each other, the position where the pattern image is generated is adjusted to be different for each image station with different color in the sub-scanning direction. Thus, as illustrated in FIG. 5B, the position where the pattern image is generated for each image station with different color in the sub-scanning direction is different from each other.

By controlling the timing as described above, the length of the image pattern in the sub-scanning direction can be properly set at the integral multiple of the circumferential length of the photoreceptor or at a length with a slight allowance so as to stabilize the toner density, thereby enabling to set at a length necessary and enough to determine the first and the second conditions suitable for the photoreceptor rotation cycle. Accordingly, the length of the image pattern in the sub-scanning direction need not include such an allowance as to be coincident to the circumferential length of the photoreceptor, so that a toner yield or the controlling time is reduced.

The determination on the first condition by the controller 37 functioning as the first image forming condition determining means is performed specifically as follows:

First, the density fluctuation component fg(t) due to the rotary oscillation of the surface of the photoreceptor is extracted from the data of the cyclic density fluctuation of the photoreceptor of the image pattern and from the cyclic potential data of the photoreceptor.

$$fg(t)=f(t)-A*V\mathrm{out}(t) \qquad \text{Formula 1}$$

wherein fg(t) is the density fluctuation component due to the rotary oscillation of the surface of the photoreceptor; f(t) is the cyclic density fluctuation data of the photoreceptor of the image pattern (to be generated based on the output from the toner image sensor 30); A is an adjustment gain 1; and Vout(t) is a potential of the image pattern exposed area (to be generated based on the output from the surface potential sensors 19Y, 19C, 19M, and 19K).

Next, the first condition VB(t) is calculated by the following formula 2.

$$VB(t)=B*fg(t) \qquad \text{Formula 2}$$

wherein VB(t) is the first condition; fg(t) is the density fluctuation component due to the rotary oscillation of the surface of the photoreceptor; and B is an adjustment gain 2.

The determination on the second condition by the controller 37 functioning as the second image forming condition determining means is performed specifically as follows:

Specifically, as shown by the following formula 3, the second condition Vg(t) is calculated using the density fluctuation component fg(t) due to the rotary oscillation of the surface of the photoreceptor which is extracted based on the cyclic density fluctuation data of the photoreceptor of the image pattern and the cyclic exposed area potential data of the photoreceptor according to the formula 1.

$$Vg(t)=C*fg(t) \qquad \text{Formula 3}$$

wherein Vg(t) is the second condition; fg(t) is the density fluctuation component due to the rotary oscillation of the surface of the photoreceptor; and C is an adjustment gain 3.

By calculating as above, the first condition and the second condition are calculated and a control table for only the rotary oscillation component of the photoreceptor is generated. However, a correction amount for the density fluctuation responsive to the sensitivity change of the photoreceptor drums 2Y, 2M, 2C, and 2K according to the image density in each of the first condition and the second condition is different.

The adjustment gains each are adjusted individually to an actual waveform.

The adjustment gains are susceptive to the use environment such as temperature and humidity of the image forming apparatus 100. In such a case, the adjustment gains may be previously prepared and listed in the table corresponding to such a use environment, stored in the nonvolatile memory and/or the volatile memory included in the controller 37, and read and used in accordance with the use environment of the image forming apparatus 100.

As understood in each formula, the outputs of the toner image sensor 30 and the surface potential sensors 19Y, 19C, 19M, and 19K are used for determination on both the first condition and the second condition. Because the determination of the second condition is reflected by the first condition, the adjustment gain used for the determination of the second condition is reflected by the adjustment gain used for the determination of the first condition.

Thus, without generating an image pattern as to the image density as a control target of the second condition, the second condition can be obtained by a calculation alone using the data used for the determination of the first condition, thereby reducing the toner yield and the control time. However, the image pattern as to the image density being a control target of the second condition and the image pattern for obtaining the first condition can be generated separately. Even in this, the length in the sub-scanning direction of the image pattern as to the image density as a control target in the second condition does not need such a great allowance corresponding to the circumferential length of the photoreceptor, thereby obtaining an advantage of reducing the toner yield and the control time.

Figure 13:
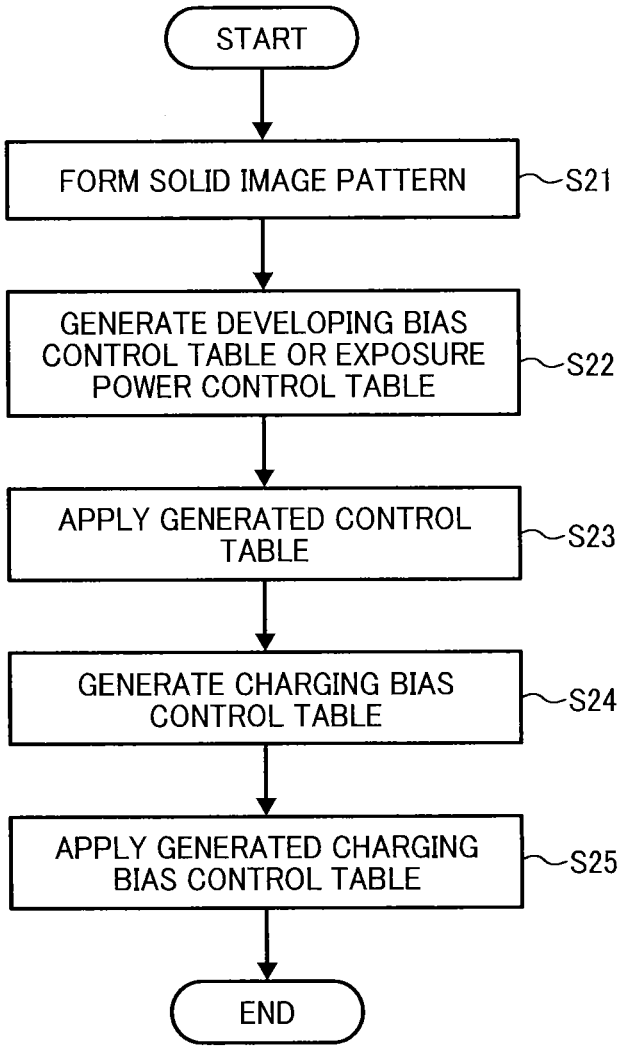
FIG. 13 is a flowchart illustrating another control to minimize the density fluctuation.
Figure 14:
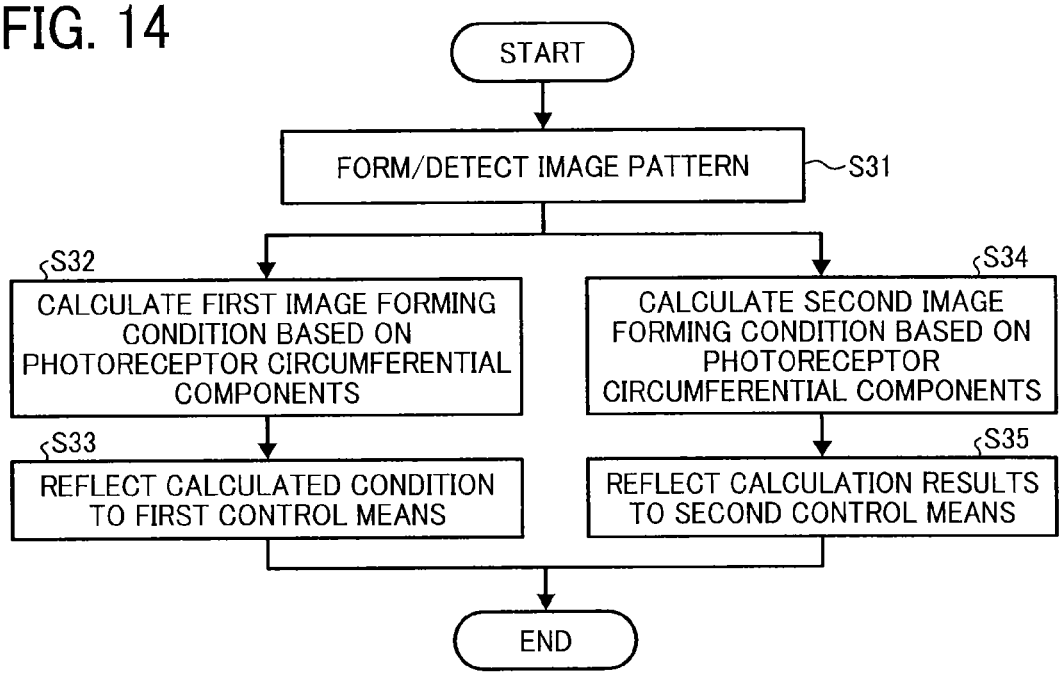
FIG. 14 is a flowchart illustrating further another control to minimize the density fluctuation.

FIGS. 12 to 14 are flowcharts illustrating an overall control as described above.

Referring to FIG. 12, first, image patterns for each color are generated and detected (in step S11). Herein, the exposed area potential of the image pattern is detected at the same time. Next, based on the detection of the cyclic component of the density fluctuation of the photoreceptor and the cyclic component of the exposed are potential of the photoreceptor, the density fluctuation due to the rotary oscillation of the photoreceptor is calculated. Then, based on the calculated density fluctuation, the first image forming condition is calculated as the first condition (that is, a control table for the developing condition or the exposure condition among image forming conditions is formed) (in step S12). Then, the controller 37, functioning as the first control means, allows the generated control table to be set for use and reflected in the first condition control (S13).

Next, based on the detection of the cyclic component of the density fluctuation of the photoreceptor, the cyclic component of the exposed area potential of the photoreceptor, and the influence of the first condition to the density as a control target in the second condition, the second image forming condition is calculated as the second condition (that is, a control table of the charging condition, one of the image forming conditions, is generated) (in step S14). Then, the controller 37, functioning as the second control means, allows the generated control table to be set for use and reflected in the control of the second condition (S15).

As described above, the image pattern is a solid image. The first condition is the developing bias as a developing condition in the developing units 5Y, 5M, 5C, and 5K or the exposure power as the exposure condition in the optical write units 4Y, 4M, 4C, and 4K. The second condition is the charging bias as the charging condition in the chargers 3Y, 3C, 3M, and 3K. FIG. 13 shows a process flowchart when applying the corresponding values to the flowchart in FIG. 12.

Specifically, first, solid image patterns which are high density uniform density image patterns are generated for each color and detected (in step S21). In this case, the exposed area potential of the solid image pattern is detected at the same time. Next, based on the detection of the cyclic component of the solid image density fluctuation and the cyclic component of the exposed area potential of the photoreceptor, the density fluctuation due to the rotary oscillation of the photoreceptor is calculated. Then, based on the calculated density fluctuation, the developing bias condition (that is, a control table of the developing units 5Y, 5M, 5C, and 5K is generated) and/or the exposure power condition (that is, a control table for the optical write units 4Y, 4M, 4C, and 4K is generated) are calculated (in step S22). The generated control table is reflected to the control performed by the controller 37 which functions as the first control means to the developing units 5Y, 5M, 5C, and 5K and/or the optical write units 4Y, 4M, 4C, and 4K.

Next, based on the detection of the cyclic component of the solid image density fluctuation, the cyclic component of the exposed area potential of the photoreceptor, and the influence of the first condition to the density as a control target in the second condition, the charging bias condition is calculated (that is, a control table of the chargers 3Y, 3C, 3M, and 3K is generated) (in step S24). The generated control table is reflected to the control performed by the controller 37 which functions as the second control means to the chargers 3Y, 3C, 3M, and 3K (S25).

The similar control as above may be applied to the operation as shown in the flowchart of FIG. 14.

According to the control as shown in FIGS. 12 and 13, because the second image forming condition is determined such that the influence of the control performed by the controller 37, which functions as the first control means, with respect to the developing units 5Y, 5M, 5C, and 5K and/or the optical write units 4Y, 4M, 4C, and 4K according to the first image forming condition is cancelled, the first series of controls to which the first condition is calculated and applied and the second series of controls to which the second condition is calculated and applied are serially performed in this order.

As processed serially as above, the control by the controller 37 functioning as the first control means, is reflected to the control by the controller 37 functioning as the second control means while the influence exerted to the second condition being detected.

Theoretically, if the gain when calculating the image forming condition (or the control table) is properly determined, even though the control flow as illustrated in FIG. 14 in which the correction of the first series and the second series is performed in parallel is performed, the first condition and the second condition are properly set.

The previously-set gain is not always optimal for each apparatus due to the individual difference of the apparatus, and the control by the controller 37 functioning as the first control means may increase the density fluctuation of the image as a control target by the second condition. Specifically, if the first condition and the second condition as parameters determined by performing the first series and the second series in parallel are used and the cyclic fluctuation of the photoreceptor according to the control table is obtained, development potentials cyclically change and a ratio with the background potential changes. Thus, the density fluctuation occurs inversely in the halftone image density portion.

In contrast, in the control flow as illustrated in FIGS. 12 and 13, after the first condition has been determined, assuming that there would be a halftone image density fluctuation due to the influence of the first condition, a control table of the developing bias that is effective to the halftone image density control and will change the background potential is generated so as to cancel the halftone image density fluctuation. Accordingly, there is an advantage that because the second image forming condition (i.e., the control table) is determined so that the density fluctuation occurring to the halftone image due to the first condition can be lowered, the density fluctuation occurring to the halftone image density portion can be reduced. Alternatively, if the gain is property set so as to cancel the influence of the first condition, the order of the control flow is switched such that the second series is performed first, and then, the first series.

FIG. 14 shows an example of control in which the first series to calculate the first condition and apply it and the second series to calculate the second condition and apply it are performed in parallel, not serially as in FIGS. 12 and 13.

In the example as illustrated in FIG. 14, similarly to the aforementioned example of control, the image pattern is generated for each color and is detected as well as the exposed area potential of the image pattern is detected (in step S31). However, after the detection of the image pattern and the exposed area potential, the first series and the second series are independently performed in parallel, in which each of the first and second series includes: detection of the cyclic component of the density fluctuation of the photoreceptor; calculation of the image forming condition and generation of the control table as to the image forming condition; and reflecting the obtained condition to the control means so that the generated control table is used.

Specifically, based on the detection of the cyclic component of the density fluctuation of the photoreceptor and the cyclic component of the exposed area potential of the photoreceptor as to the image pattern, the density fluctuation due to the rotary oscillation of the photoreceptor is calculated. Then, based on the calculated density fluctuation, the first image forming condition is calculated as the first condition (that is, a control table for the developing condition and/or the exposure condition among image forming conditions is formed) (in step S32). Then, the generated control table is set to be used by the controller 37 functioning as the first control means and is reflected to the control of the first condition (S33). In parallel, based on the detection of the cyclic component of the density fluctuation of the photoreceptor, the cyclic component of the exposed area potential of the photoreceptor, and the influence of the first condition to the density of the control target as the second condition, the second image forming condition is calculated as the second condition (that is, a control table for the charging condition among image forming conditions is formed) (in step S34); and the generated control table is set to be used by the controller 37 functioning as the second control means and is reflected to the control of the second condition (S35). The detection of the cyclic component of the density fluctuation of the photoreceptor may be performed in step S31.

In the control performed in FIG. 14, without generating an image pattern as to the image density as a control target of the second condition, the second condition can be obtained by a calculation alone using the data used for the determination of the first condition, thereby reducing the toner yield and the control time.

In addition, in the control performed in FIG. 14, if the gain is properly obtained, a similar control effect can be obtained as in the control flows as illustrated in FIGS. 12 and 13.

The above control flows can be repeated several times. Specifically, image formation is performed by operating the developing units 5Y, 5M, 5C, and 5K and the chargers 3Y, 3C, 3M, and 3K according to the determined first and second conditions, the image pattern is formed as an image of which density is detected by the toner image sensor 30, the density is detected by the toner image sensor 30, and the first condition and the second condition are re-determined, and image formation is performed as instructed by the user according to the re-determined first and second conditions.

When installing the aforementioned control in an actual apparatus, the gain may be initially set to lower in the control table in order to prevent excessive correction. In such a case, the image density fluctuation cannot be removed in one correction operation. Then, by repeatedly performing a series of correction controls, the density fluctuation can be further reduced. The repetition may be performed once or a number of times; however, the repeated formation of the image pattern is disadvantageous in terms of the control time and toner yield. It is therefore preferred that the gain be set so that one time correction suffices for obtaining a control effect and several times of correction controls are unnecessary.

As described above, the photoreceptor drums 2Y, 2M, 2C, and 2K and the developing rollers 5Ya, 5Ca, 5Ma, and 5Ka are rotary member each of which may generates a development gap. The rotary oscillation is assumed to be a rotation fluctuation component occurring from the photoreceptor drums 2Y, 2M, 2C, and 2K in the aforementioned embodiment. In actuality, the fluctuation of the development gap also occurs from a rotary oscillation as a rotation fluctuation component of the developing rollers 5Ya, 5Ca, 5Ma, and 5Ka.

Accordingly, the rotary member to form the image pattern of which density is detected by the toner image sensor 30 is set as the photoreceptor drums 2Y, 2M, 2C, and 2K and/or the developing rollers 5Ya, 5Ca, 5Ma, and 5Ka, the rotational position of the developing rollers 5Ya, 5Ca, 5Ma, and 5Ka is detected by a rotational position detector such as the photo interrupters 18Y, 18C, 18M, and 18K, and the detection of the density fluctuation and the determination of the first and second conditions can be performed based on the detected rotational position.

Figure 15:
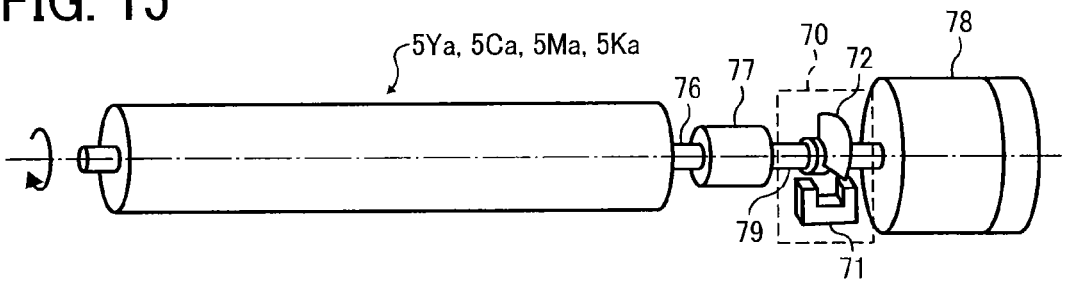
FIG. 15 is a schematic oblique view of the rotational position detector.

FIG. 15 shows a developer rotational position detector 70 including a photo interrupter 71 as a detector to detect a rotational position of the developing rollers 5Ya, 5Ca, 5Ma, and 5Ka as developer carriers.

The developer rotational position detector 70 is provided individually to each of the developing rollers 5Ya, 5Ca, 5Ma, and 5Ka but a structure thereof is similar as illustrated in FIG. 15. Further, as illustrated in FIG. 15, each of the developing rollers 5Ya, 5Ca, 5Ma, and 5Ka is disposed on a rotary center axis 76 connected to an axis 79, a motor output axis of a drive motor 78, via a coupling 77. Therefore, the developer rotational position detector 70 is driven to rotate by the drive of the drive motor 78.

The rotational position detector 70 further includes a shield member 72 which is integrally formed with the axis 79 and rotates accompanied by a rotation of the axis 79. The shield member 71 is detected by the photo interrupter 71 when the developing rollers 5Ya, 5Ca, 5Ma, and 5Ka take a predetermined position according to the rotation thereof. Thus, the photo interrupter 71 detects a rotational position of each of the developing rollers 5Ya, 5Ca, 5Ma, and 5Ka. In the similar manner, each of the photo interrupters 18Y, 18C, 18M, and 18K also detects a rotational position of each of the photoreceptor drums 2Y, 2M, 2C, and 2K.

In FIG. 15, the developing rollers 5Ya, 5Ca, 5Ma, and 5Ka are driven by a direct drive method directly connecting to the drive motor, but a speed reducer may be included in the drive transmission from the drive motor 78. When a speed reducer is installed, the shield member 72 is preferably mounted on the axis 76 so that the shield member 72 and each of the developing rollers 5Ya, 5Ca, 5Ma, and 5Ka are set to the same rotary speed. The same is applied to a case in which the rotational position of the photoreceptor drums 2Y, 2M, 2C, and 2K is detected.

Figure 16:
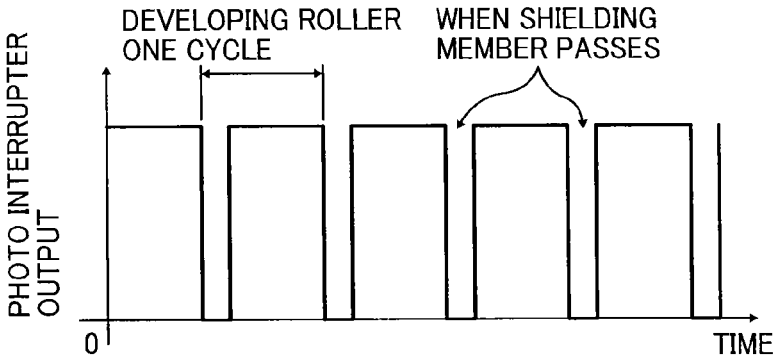
FIG. 16 is a timing chart illustrating an example of a signal from the rotational position detector as illustrated in FIG. 15.

FIG. 16 shows an example of an output from the photo interrupter 71. It can be seen that the output is decreased to substantially zero when the shield member 72 rotating in sync with the developing rollers 5Ya, 5Ca, 5Ma, and 5Ka passes by the photo interrupter 71. Using this sharp decrease in the output, the rotational position of the developing rollers 5Ya, 5Ca, 5Ma, and 5Ka is detected.

Based on the rotational position signal detected by the developer rotational position detector 70, the data processing and various corrections and controls can be performed.

For example, the averaging process of the image density of the image pattern detected by the toner image sensor 30 is performed based on the signal from the photo interrupter 71.

Specifically, the controller 37 serving as the image density data storage device relates the image density with a phase of the developing rollers 5Ya, 5Ca, 5Ma, and 5Ka based on the signals from the photo interrupter 71, and performs an averaging process to the image density by the rotation cycle of the developing rollers 5Ya, 5Ca, 5Ma, and 5Ka. Thus, the image density related to the phase of the photoreceptor drums 2Y, 2M, 2C, and 2K, corresponding to f(t), is obtained and stored. Following is a description along with the measurement data.

Figure 17:
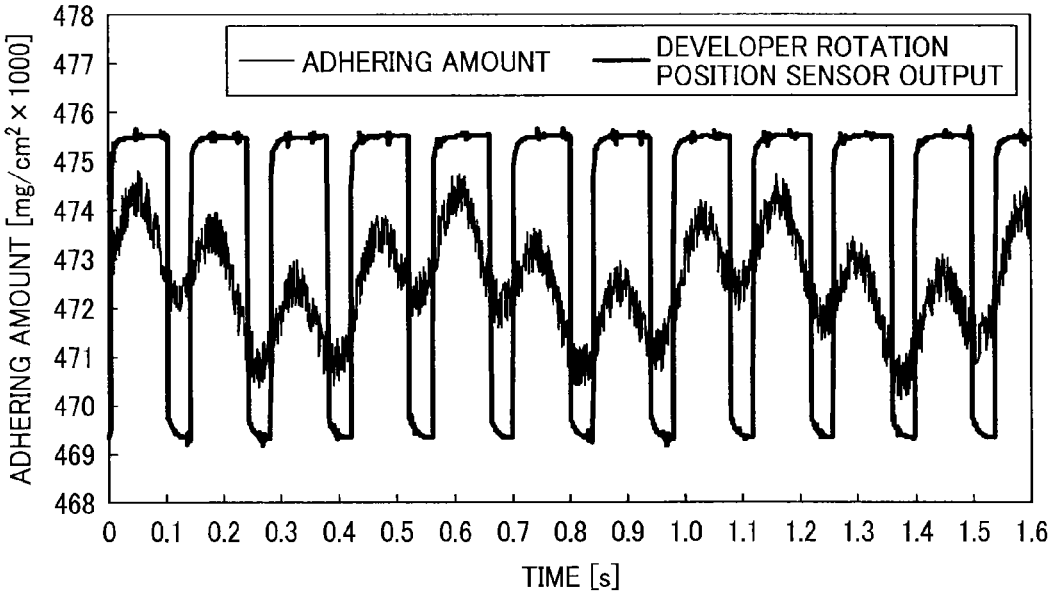
FIG. 17 is a timing chart illustrating a relation between the signal from the rotational position detector and the toner adhering amount detection signal by the image density detector.
Figure 18:
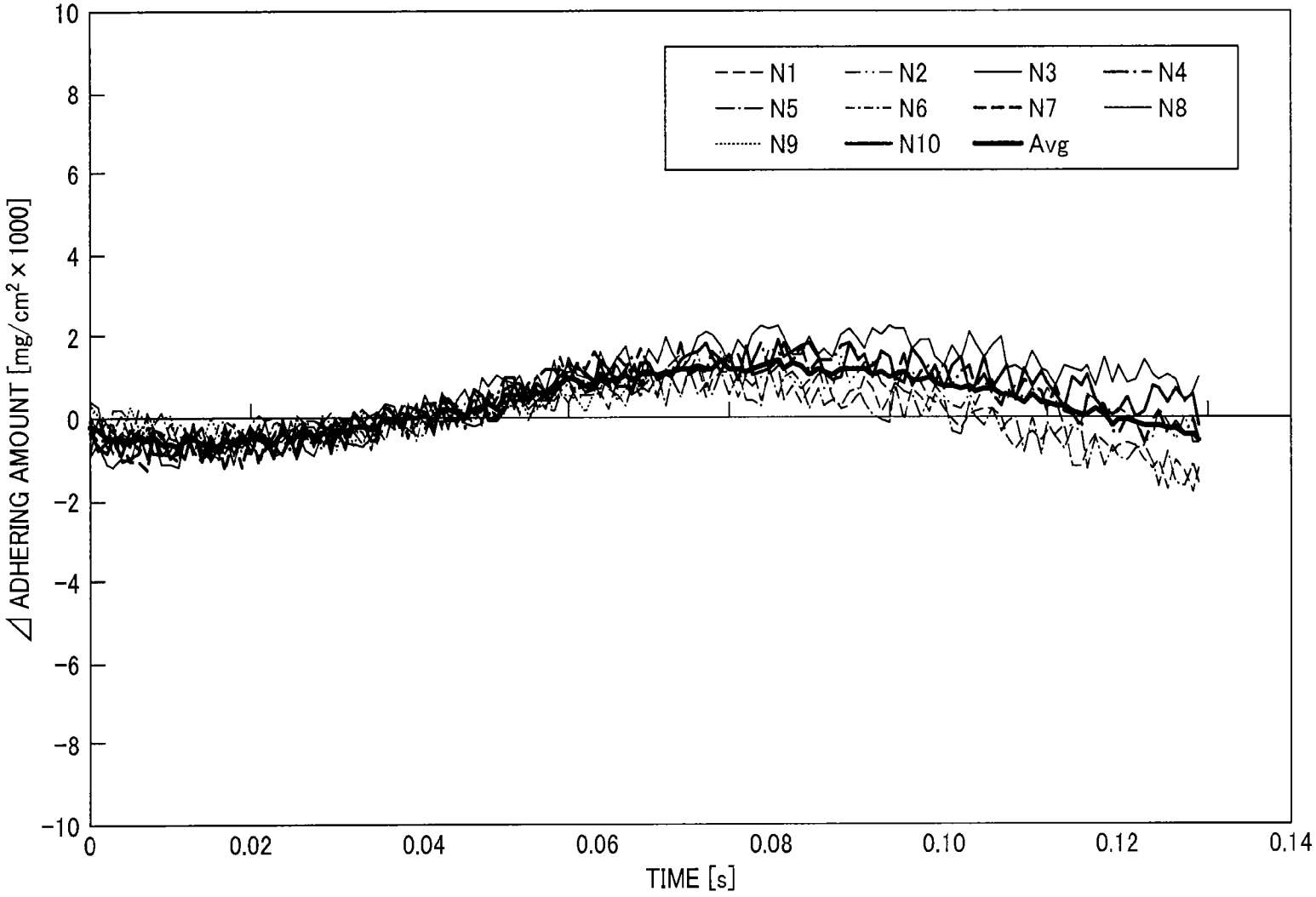
FIG. 18 is a graph illustrating an averaging process of the toner adhering amount detection signal by the image density detector based on the signal from the rotational position detector as illustrated in FIG. 15.

FIG. 17 shows measurement results of the image density of the image pattern detected by the toner image sensor 30 and the output signal of the photo interrupter 71, in which the toner adhering amount and the output signal are represented in a synchronized manner along the horizontal time axis. The vertical axis of the graph in FIG. 18 represents a toner adhering amount [mg/cm2×1,000].

The image pattern as described referring to FIGS. 5A and 5B is detected by the toner image sensor 30 and is converted into a toner adhering amount. The adhering amount conversion algorithm will not be described as is similar to the related technology.

In FIG. 17, a mountainous line shows the toner adhering amount corresponding to the image density and a rectangular line shows an output of the photo interrupter 71. As observed in FIG. 17, it can be seen that the image pattern includes cyclic fluctuations corresponding to the rotation cycle of the developing rollers 5Ya, 5Ca, 5Ma, and 5Ka.

The cyclic fluctuations may include other cyclic fluctuation component, for example, a noise such as a density fluctuation due to the rotary oscillation of the photoreceptor drums 2Y, 2M, 2C, and 2K.

Then, the image density of the image pattern detected by the toner image sensor 30 is cut out by the output signal of the photo interrupter 71, the obtained value is subject to the averaging process, and the thus-obtained result is correction data for the image density or the toner adhering amount, which is stored as the image density in chronological order by the controller 37 as the image density data storage device.

FIG. 18 shows a waveform of the toner adhering amount for a rotation of the developing rollers 5Ya, 5Ca, 5Ma, and 5Ka. When each rotation is observed, each waveform N1 to N10 showing the detected image density of the image pattern represented in thin lines is turbulent including other cyclic fluctuation component, but the averaging process result in a thick solid line extracts an original developing roller cyclic component by performing an averaging process.

In the similar manner, each of the photoreceptor drums 2Y, 2M, 2C, and 2K is subject to the averaging process in the rotation cycle. Accordingly, the cyclic density fluctuation data of the photoreceptor and the cyclic density fluctuation of the developing roller are discussed on the assumption that the each data is the data after being subjected to the averaging process.

In the present example, data for 10 cycles from N1 to N10 is obtained and an additive averaging process is performed; however, if the developing roller cyclic component is extracted, other averaging process may be applied.

Thus, in a method in which the rotational position of the photoreceptor drums 2Y, 2M, 2C, and 2K and the rotational position of the developing rollers 5Ya, 5Ca, 5Ma, and 5Ka are detected, the density fluctuation component caused from the photoreceptor drums 2Y, 2M, 2C, and 2K and the density fluctuation component caused from the developing rollers 5Ya, 5Ca, 5Ma, and 5Ka are independently extracted.

These components are detected in the superimposed manner as a density fluctuation of the image pattern as explained along with FIGS. 6 to 8, but can be independently extracted. Then, a correction amount to each component is superimposed so that the density fluctuation can be canceled, thereby enabling to determine the first and second conditions.

In this case, the length of the image pattern and the position thereof are set based on the longer circumferential length among the circumferential length of the photoreceptor drums 2Y, 2M, 2C, and 2K and that of the developing rollers 5Ya, 5Ca, 5Ma, and 5Ka, the rotational position, the interval, and the process linear speed. Normally, because the circumferential length of the photoreceptor drums 2Y, 2M, 2C, and 2K is longer, the length of the photoreceptor drums 2Y, 2M, 2C, and 2K is employed.

By contrast, if among the rotational position of the photoreceptor drums 2Y, 2M, 2C, and 2K and that of the developing rollers 5Ya, 5Ca, 5Ma, and 5Ka, the rotational position of the developing rollers 5Ya, 5Ca, 5Ma, and 5Ka is to be detected, the density fluctuation component due to the developing rollers 5Ya, 5Ca, 5Ma, and 5Ka is extracted, and the first condition and the second condition are determined such that the extracted density fluctuation component can be canceled, and the image formation is performed based on the determined first and second conditions.

In this case, the length of the image pattern and the position thereof are set based on the circumferential length, the rotational position, the interval, and the process linear speed of the developing rollers 5Ya, 5Ca, 5Ma, and 5Ka.

Herein, the interval means a distance between the developing nip and the detection position of the image pattern by the toner image sensor 30 along the sub-scanning direction.

Generation of the image pattern is performed at a proper timing based on either of the rotational position of the photoreceptor drums 2Y, 2M, 2C, and 2K detected by the photo interrupters 18Y, 18C, 18M, and 18K or the rotational position of the developing rollers 5Ya, 5Ca, 5Ma, and 5Ka detected by the photo interrupter 71.

Therefore, for a proper timing to be taken, either of the rotational position of the photoreceptor drums 2Y, 2M, 2C, and 2K or the rotational position of the developing rollers 5Ya, 5Ca, 5Ma, and 5Ka can be detected. Therefore, either of the photo interrupters 18Y, 18C, 18M, and 18K or the photo interrupter 71 is enough to be provided. Specifically, the rotary member to form the image pattern of which density is to be detected by the toner image sensor 30 is either the photoreceptor drums 2Y, 2M, 2C, and 2K or the developing rollers 5Ya, 5Ca, 5Ma, and 5Ka.

The controller 37 stores an image forming program, as an image density control program, and enables the image density control method in which the image pattern is formed and image density control method is performed. The controller 37 or the nonvolatile memory and/or the volatile memory function as an image forming program storage device. Such an image forming program can be stored not only in the nonvolatile memory and/or the volatile memory disposed in the controller 37 but in semiconductor devices such as a RAM, optical devices such as a DVD, MO, MD, CD-R, and the like, or electromagnetic devices such as a Hard-Disk, magnetic tape, flexible disk, and the like. When such a memory or other storage device is used to store the image forming program, such devices may configure a computer-readable recording medium storing the image forming program.

Preferred embodiments of the present invention have been described heretofore; however, the present invention is not limited to the described embodiments and various modifications are possible within the scope of claims unless explicitly limited in the description.

For example, the image forming apparatus to which the present invention is applied may be a copier, a printer, a facsimile, a plotter, and a multifunction apparatus having at least two functions of the above devices in combination such as a color digital apparatus enabling image formation of a full color image. Recently, color image formable image forming apparatuses are popular due to demands in the market; however, the image forming apparatus to which the present invention is applied may be a monochrome one.

Such image forming apparatuses are preferably of the type capable of employing, as a recording medium on which image formation is performed, a regular sheet of paper, an OHP sheet, thick sheet such as a card, a postcard, or an envelop. Such image forming apparatuses may be of a type in which only one-sided printing is possible. Developer to be used in such image forming apparatuses may be of one-component type developer and otherwise two-component type developer.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image carrier;

a developer carrier configured to adhere toner onto the image carrier;

an image density detector to detect a density of an image on the image carrier formed by the developer carrier adhering the toner onto the image carrier;

a rotary member to form an image pattern of which the density is detected by the image density detector;

a rotational position detector to detect a rotational position of the rotary member; and circuitry configured to generate the image pattern based on the rotational position detected by the rotational position detector so that the image pattern is in synchronization with a rotational position detection signal of the rotational position detector, and to generate the image pattern so that a leading end of the image pattern in a sub-scanning direction coincides with a rising of the rotational position detection signal of the rotational position detector, and to calculate a cyclic density fluctuation of the image pattern by determining a relation between the density of the image pattern detected by the image density detector with a rotational phase of the rotary member that is determined based on the rotational position detected by the rotational position detector.

2. The image forming apparatus as claimed in claim 1, wherein the rotational position detector detects the rotational position of one of the image carrier and the developer carrier.

3. The image forming apparatus as claimed in claim 1, wherein the image pattern is formed while image forming conditions are held constant, the image forming conditions include a charging condition, an exposure condition, an image writing condition, an image developing condition, and an image transfer condition.

4. The image forming apparatus as claimed in claim 1, further comprising a writing unit, wherein the circuitry is configured to determine at least one of a leading end and a trailing end position of the image pattern formed on the rotary member in the sub-scanning direction responsive to:

the rotational position of the rotary member detected by the rotational position detector;

an interval between a writing position on the image carrier at which the writing unit adheres toner and a detection position of the image pattern by the image density detector; and a process linear speed of the rotary member over the interval.

5. The image forming apparatus as claimed in claim 4, further comprising a timer to measure an elapsed time from when the rotational position has been detected by the rotational position detector, wherein the circuitry is configured to determine the at least one of the leading end and the trailing end position of the image pattern formed on the rotary member in the sub-scanning direction based on the elapsed time measured by the timer.

6. The image forming apparatus as claimed in claim 1, further comprising:

a first image forming device that adjusts the density using a first element to form the image; and wherein the circuitry is configured to determine a first condition as to the first element to adjust the density based on the cyclic density fluctuation of the image pattern of one circumferential length of the rotary member detected by the image density detector, wherein the image is formed by operating the first image forming device in accordance with the first condition.

7. The image forming apparatus as claimed in claim 6, wherein the formation of the image to determine the first condition by the circuitry is performed in synchronization with the rotational position of the rotary member detected by the rotational position detector.

8. The image forming apparatus as claimed in claim 6, further comprising:

a second image forming device to adjust the density using a second element to form an image; and wherein the circuitry is configured to determine a second condition as to the second element to adjust the density based on the cyclic density fluctuation, wherein image formation is performed while operating the first image forming device in accordance with the first condition as well as operating the second image forming device in accordance with the second condition.

9. The image forming apparatus as claimed in claim 8, wherein image formation to perform the second condition determination by the circuitry is performed in synchronization with the rotational position of the rotary member detected by the rotational position detector.

10. The image forming apparatus as claimed in claim 8, wherein the first condition determination by the circuitry, the second condition determination by the circuitry, the operation of the first image forming device responsive to the first condition, and the operation of the second image forming device responsive to the second condition are all in synchronization with the rotational position detected by the rotational position detector.

11. The image forming apparatus as claimed in claim 1, wherein the circuitry is configured to calculate a component of the cyclic density fluctuation of the image pattern that is due to fluctuation of a development gap between the image carrier and the developer carrier.

12. The image forming apparatus as claimed in claim 1, wherein the circuitry is configured to generate the image pattern based on the rotational position detected by the rotational position detector so that the image pattern is generated in synchronization with a cycle of the rotational position detection signal of the rotational position detector.

13. An image forming method to form an image pattern, using an image carrier; a developer carrier configured to adhere toner onto the image carrier; an image density detector to detect a density of an image on the image carrier formed by the developer carrier adhering the toner on the image carrier; a rotary member to form an image pattern of which the density is detected by the image density detector; and a rotation position detector to detect a rotation position of the rotary member, comprising:

detecting the rotation position by the rotation position detector;

forming an image pattern on the rotary member based on the detected rotation position so that the image pattern is in synchronization with a rotational position detection signal of the rotational position detector, and forming the image pattern so that a leading end of the image pattern in a sub-scanning direction coincides with a rising of the rotational position detection signal of the rotational position detector;

detecting the density of the image pattern by the image density detector; and calculating a cyclic density fluctuation of the image pattern by determining a relation between the density of the image pattern detected by the image density detector and a rotational phase of the rotary member that is determined based on the rotational position detected by the rotational position detector.

14. The image forming method as claimed in claim 13, wherein the calculating includes calculating a component of the cyclic density fluctuation of the image pattern that is due to fluctuation of a development gap between the image carrier and the developer carrier.

15. The image forming method as claimed in claim 13, wherein the forming includes forming the image pattern on the rotary member based on the detected rotation position so that the image pattern is generated in synchronization with a cycle of the rotational position detection signal of the rotational position detector.

* * * * *